US008197238B2

(12) United States Patent
Yamamuro et al.

(10) Patent No.: US 8,197,238 B2
(45) Date of Patent: Jun. 12, 2012

(54) PUMP APPARATUS

(75) Inventors: Shigeaki Yamamuro, Zushi (JP); Hideo Konishi, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 781 days.

(21) Appl. No.: 12/351,140

(22) Filed: Jan. 9, 2009

(65) Prior Publication Data

US 2009/0180904 A1 Jul. 16, 2009

(30) Foreign Application Priority Data

Jan. 15, 2008 (JP) ..... 2008-005152

(51) Int. Cl.
*F04B 7/00* (2006.01)
*F04B 39/08* (2006.01)

(52) U.S. Cl. ..... 417/505; 417/220; 417/214; 417/367; 418/30; 418/31

(58) Field of Classification Search ..... 417/212–223, 417/362, 505; 418/30–31; 222/129, 251, 222/255.372, 383.1–383.2
See application file for complete search history.

(56) References Cited

U.S. PATENT DOCUMENTS 5,842,837 A * 12/1998 Nakayoshi et al. ..... 417/286
7,958,908 B2 * 6/2011 Cho et al. ..... 137/625.26
8,038,420 B2 * 10/2011 Uchida et al. ..... 418/26
2002/0064471 A1 * 5/2002 Kojima et al. ..... 418/30
2002/0110460 A1 * 8/2002 Kominami ..... 417/214
2005/0013716 A1 * 1/2005 Magami et al. ..... 417/555.1
2005/0047929 A1 * 3/2005 Hanyu ..... 417/273
2007/0212243 A1 * 9/2007 Yamamuro et al. ..... 418/30

FOREIGN PATENT DOCUMENTS

JP 2004-218527 A 8/2004
JP 2006-057502 A 3/2006
JP 2007-032517 A 2/2007

* cited by examiner

*Primary Examiner* — Anne Hines
*Assistant Examiner* — Jose M Diaz
(74) *Attorney, Agent, or Firm* — Foley & Lardner LLP

(57) ABSTRACT

A pump apparatus includes a drive shaft supported rotatably in a pump body; a power transmission member attached to the drive shaft, and configured to transmit power to the drive shaft; a pump element configured to pressurize and discharge working fluid; a discharge passage formed in the pump body, and configured to introduce the pressurized working fluid-discharged from the pump element to an external of the pump body; a control valve configured to control an amount of working fluid to be discharged through the discharge passage to the external, by controlling a movement of a valving element of the control valve on the basis of the pressurized working fluid; and an electromagnetic valve provided between the power transmission member and the control valve, and configured to control the control valve or a fluid pressure acting on the valving element of the control valve based on the pressurized working fluid.

15 Claims, 14 Drawing Sheets

PUMP APPARATUS

BACKGROUND OF THE INVENTION

The present invention relates to an improvement of a pump apparatus which is used as, for example, a drive source for a hydraulic power steering system of vehicle.

Japanese Patent Application Publication No. 2006-57502 discloses a previously-proposed pump apparatus which is applied to, for example, the hydraulic power steering system of vehicle.

This pump apparatus includes a flow-rate control valve for controlling a pump discharge amount. A displacement (movement) of a valving element of the flow-rate control valve is controlled by an electromagnetic valve provided as a unit separate from the pump apparatus. Accordingly, a distribution between a flow rate to be supplied to a load side and a flow rate to be returned to a reservoir tank side can be varied so that the pump discharge amount is controlled.

SUMMARY OF THE INVENTION

Recently, it has been desired to integrate the pump apparatus with the electromagnetic valve. When trying to unitize these the pump apparatus and the electromagnetic valve, a proper proposal about a structure and a layout of the unitized apparatus is needed with relation to a routing of fluid passages inside the unitized apparatus, an attaching form of the unitized apparatus, an installation space or the like.

It is therefore an object of the present invention to provide a proper structure and the like of a pump apparatus integrated with an electromagnetic valve.

According to one aspect of the present invention, there is provided a pump apparatus comprising: a drive shaft supported rotatably in a pump body; a power transmission member attached to one end portion of the drive shaft, and configured to transmit a power to the drive shaft; a pump element received in the pump body, and configured to pressurize and discharge a working fluid by receiving a rotary drive of the drive shaft; a discharge passage formed in the pump body, and configured to introduce the pressurized working fluid discharged from the pump element to an external of the pump body; a control valve provided in the pump body, and configured to control an amount of working fluid to be discharged through the discharge passage to the external, by controlling a movement of a valving element of the control valve on the basis of the pressurized working fluid; and an electromagnetic valve provided between the power transmission member and the control valve in an axial direction of the drive shaft, and configured to control the control valve or a fluid pressure acting on the valving element of the control valve based on the pressurized working fluid.

According to another aspect of the present invention, there is provided a pump apparatus comprising: a drive shaft supported rotatably in a pump body; a cam ring received in the pump body, and capable of becoming eccentric relative to the drive shaft; a rotor provided on an inner circumferential side of the cam ring, and including a plurality of slots formed in a radial direction of the rotor, the rotor being connected with the drive shaft; a plurality of vanes received in the plurality of slots of the rotor, each vane being movable in outward and inward directions of the slot, the plurality of vanes cooperating with the cam ring and the rotor to define a plurality of pump chambers; a first plate member provided on one axial end surface of the cam ring; a second plate member provided on another axial end surface of the cam ring, the first plate member and the second plate member supporting the cam ring by sandwiching the cam ring; a suction port formed in at least one of the first plate member and the second plate member, and being open to an area within which a volume of each pump chamber becomes enlarged with a rotation of the rotor; a discharge port formed in at least one of the first plate member and the second plate member, and being open to an area within which the volume of each pump chamber becomes reduced with the rotation of the rotor; a seal member provided on an outer circumferential surface of the cam ring and dividing a space formed on the outer circumferential surface of the cam ring into a first fluid pressure chamber and a second fluid pressure chamber, a volume of the first fluid pressure chamber being configured to decrease with an increase of eccentricity of the cam ring, a volume of the second fluid pressure chamber being configured to increase with the increase of eccentricity of the cam ring; a metering orifice formed in a discharge passage connected with the discharge port; a control valve configured to adjust fluid pressure to be introduced into the first fluid pressure chamber or the second fluid pressure chamber, by controlling a movement of a valving element of the control valve on the basis of an upstream fluid pressure of the metering orifice and a downstream fluid pressure of the metering orifice; a bracket attached to at least one side surface of the pump body via a connecting member; and an electromagnetic valve received by the pump body, the drive shaft being located between the bracket and the electromagnetic valve in the radial direction of the rotor, the electromagnetic valve being configured to control fluid pressure inside the pump body.

According to still another aspect of the present invention, there is provided a pump apparatus comprising: a drive shaft supported rotatably in a pump body; a power transmission member attached to an outer circumferential portion of one end side of the drive shaft, and configured to transmit a power to the drive shaft; a pump element received in the pump body, and configured to pressurize and discharge working fluid by receiving a rotary drive of the drive shaft; a suction passage formed in the pump body, connected through an inlet port formed to open to an outer surface of the pump body, with a reservoir tank for storing working fluid, and configured to introduce working fluid sucked through the inlet port, into the pump element; a discharge passage formed in the pump body, and configured to introduce the pressurized working fluid discharged from the pump element, to an external of the pump body; a control valve provided in the pump body, and configured to control an amount of working fluid to be discharged through the discharge passage to the external, by controlling a movement of a valving element of the control valve based on a pressure level of the pressurized working fluid; and an electromagnetic valve provided in the pump body on the same side as the inlet port relative to the drive shaft, and configured to control the control valve or a fluid pressure acting on the valving element of the control valve based on the pressurized working fluid.

DETAILED DESCRIPTION OF THE INVENTION

Figure 1:
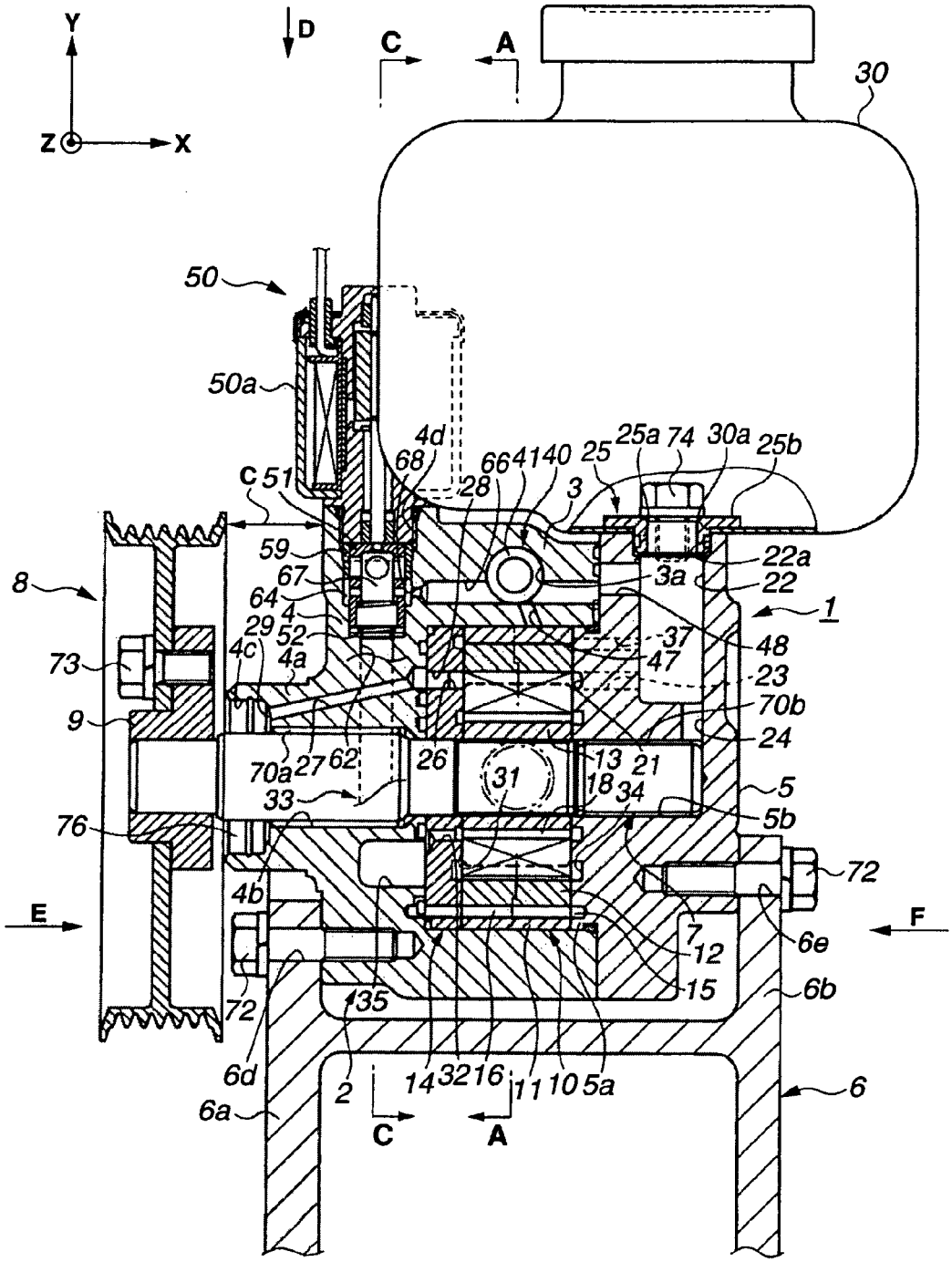
FIG. 1 is a vertical cross-sectional view showing a schematic structure of a first embodiment of a pump apparatus according to the present invention.

Reference will hereinafter be made to the drawings in order to facilitate a better understanding of the present invention. Pump apparatuses according to respective embodiments of the present invention will be explained below in detail, referring to the drawings. The following respective embodiments will give an example in the case that the pump apparatus according to the present invention is applied to a variable displacement vane pump which is used for a power steering system for vehicle.

First Embodiment

Figure 4:
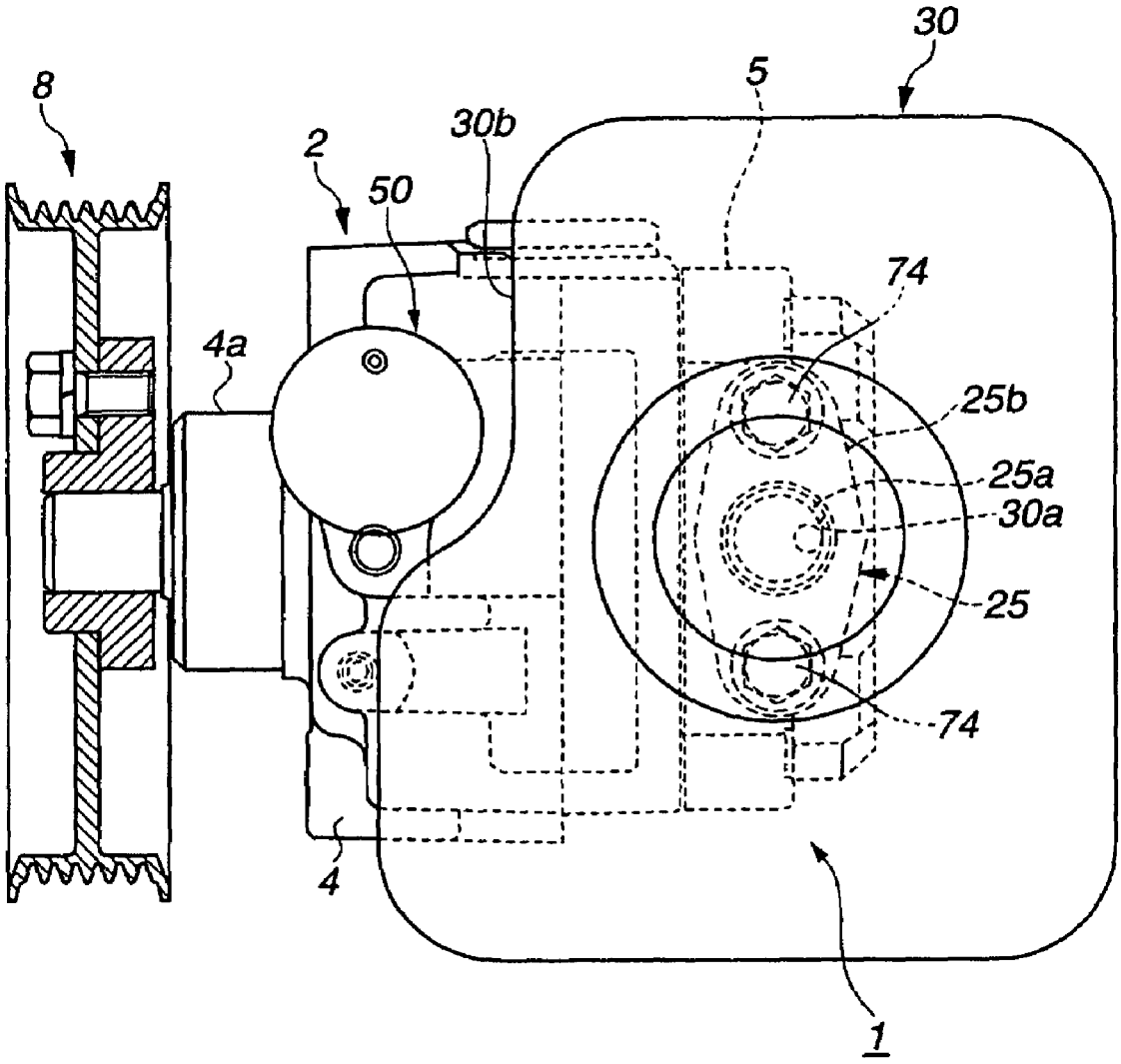
FIG. 4 is a top view of FIG. 1 as seen in a direction of an arrow D.
Figure 5:
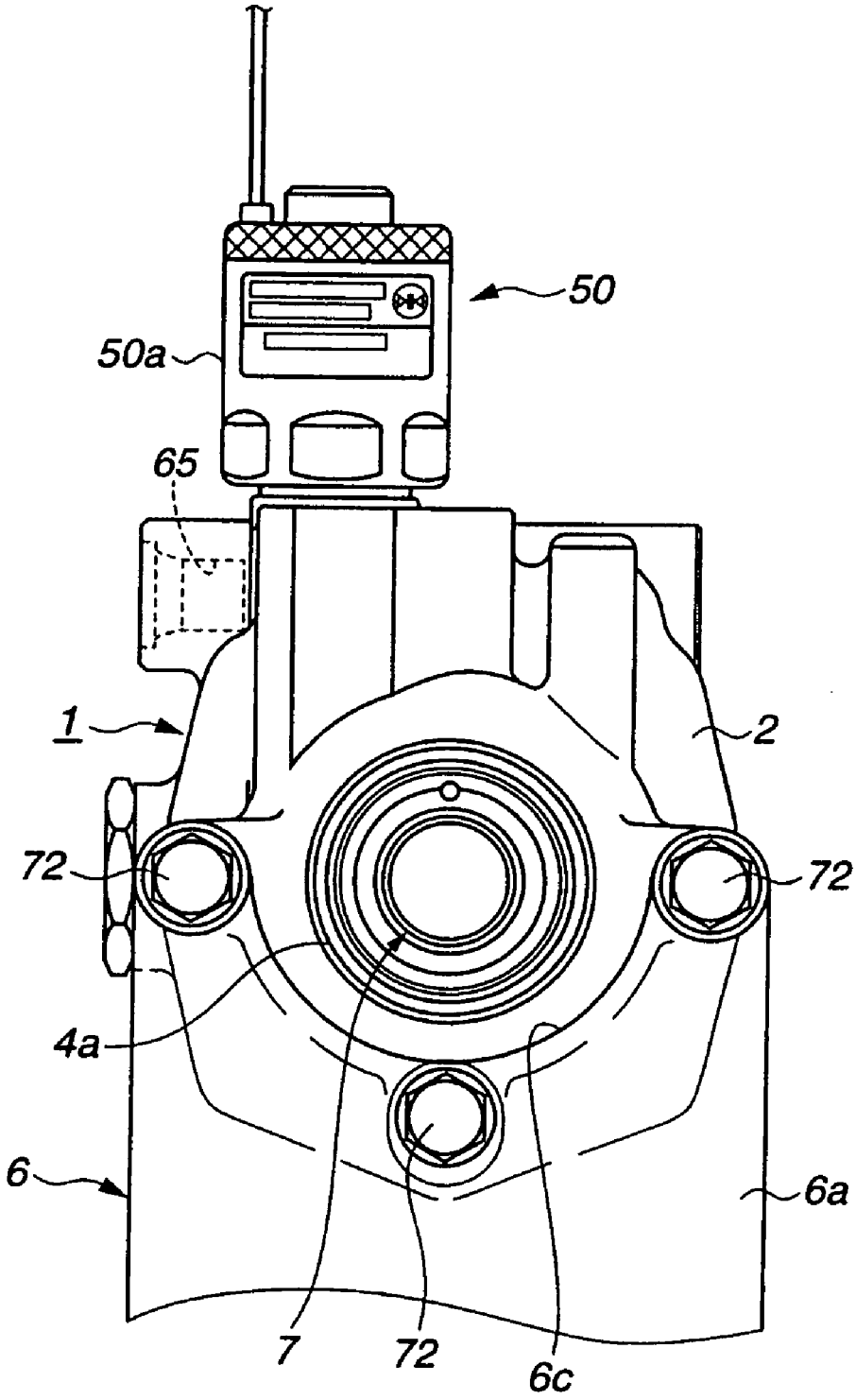
FIG. 5 is a side view of FIG. 1 as seen in a direction of an arrow E.
Figure 6:
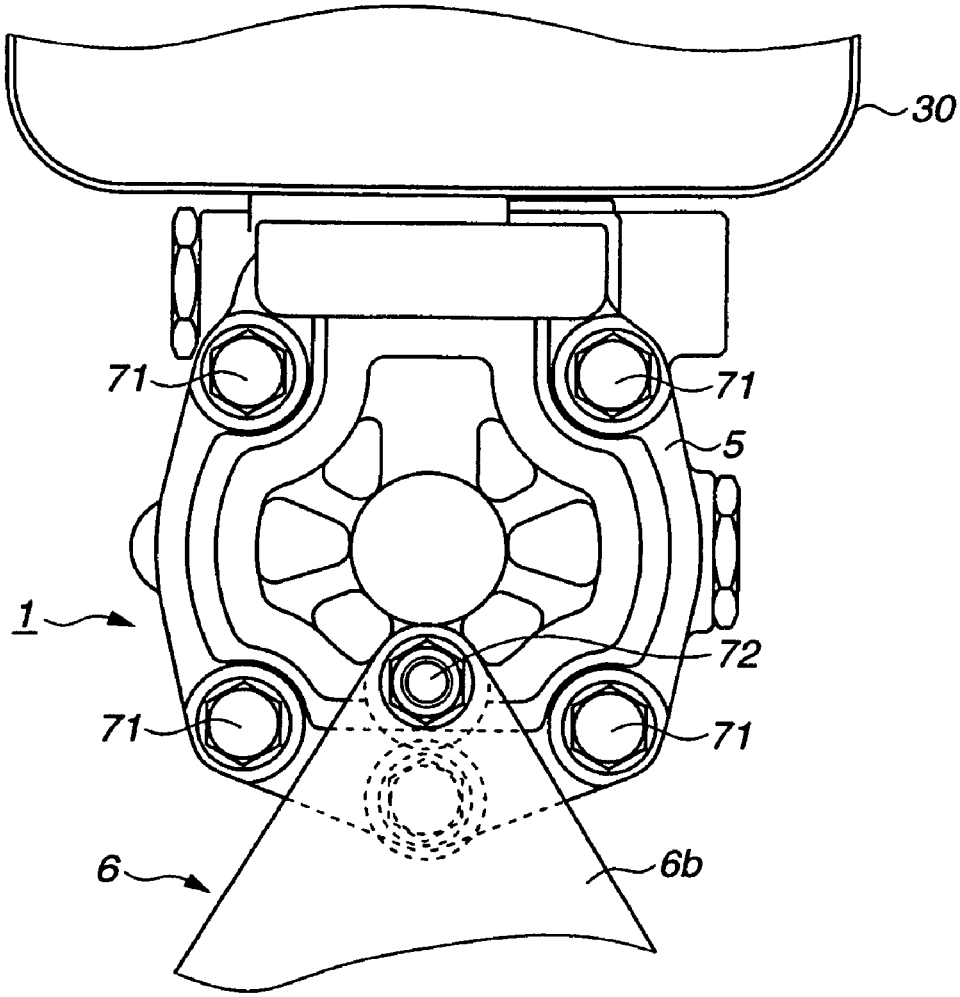
FIG. 6 is a side view of FIG. 1 as seen in a direction of an arrow F.

FIGS. 1 to 8 show a first embodiment according to the present invention. As shown in FIG. 1, a pump apparatus in the first embodiment is provided with a pump body 1 and a bracket 6. The pump body 1 is formed of aluminum alloy, and includes a front body 2 and a rear cover 5 which are produced separately from each other. The front body 2 functions as a first housing. The front body 2 includes a tubular portion 3 which opens at one end of tubular portion 3, and an end wall portion 4 provided at another end of the tubular portion 3. The rear cover 5 functions as a second housing, and also functions as a second plate member for covering or enclosing the opening at the one end of tubular portion 3. As shown in FIG. 6, the front body 2 is connected with the rear cover 5 by means of four bolts 71. The pump body 1 including the front body 2 and rear cover 5 is capable of being attached to a vehicle body through the bracket 6. The bracket 6 is fixed to an outer lateral surface (pulley-side lateral surface) of the end wall portion 4 and to an outer lateral surface (lateral surface opposite to the pulley side) of the rear cover 5. The bracket 6 is located on a lower end side of the pump body 1 as shown in FIG. 1, namely, on a pump-discharge-region side of the pump body 1 as will be discussed below.

The pump apparatus includes a drive shaft 7, a pulley 8, a pump element 10, a control valve 40, and an electromagnetic valve 50. The drive shaft 7 is supported rotatably by a first bearing 70*a* provided at an inner circumferential portion (inner-radius portion) of the end wall portion 4, and by a second bearing 70*b* provided at an inner circumferential portion (inner-radius portion) of the rear cover 5. One end portion of the drive shaft 7 is inserted into the end wall portion 4. That is, the drive shaft 7 passes from the rear cover 5 through the end wall portion 4, and then projects to an external. The pulley 8 is attached to another end portion of the drive shaft 7 and is incapable of rotating with respect to the drive shaft 7 (there is no relative rotation between drive shaft 7 and pulley 8). The pulley 8 functions as a power transmission member for transmitting drive force of an engine (not shown) to the drive shaft 7. The pump element 10 is housed in or received on an inner circumferential side (inner-radius side) of the tubular portion 3. The pump element 10 carries out a pumping action by receiving a rotary drive of the drive shaft 7. The control valve 40 controls or adjusts a discharge flow rate (pump flow amount) which is discharged or released from the pump element 10. The electromagnetic valve 50 controls a movement of a valving element (valve plug) 41 constituting the control valve 40.

The front body 2 includes a tubular base 4*a* at a substantially center portion of the end wall portion 4. The tubular base 4*a* protrudes toward the side of pulley 8 in an axial direction (in x-axis direction of FIG. 1). The tubular base 4*a* is formed with a bearing receiving portion 4*b* for housing and holding the first bearing 70*a*, on an inner circumferential side of the tubular base 4*a*. This bearing receiving portion 4*b* is formed in a penetrating manner to have a diameter (inside diameter of the tubular base 4*a*) larger than an outside diameter of the drive shaft 7. The tubular base 4*a* is formed with a seal holding portion 4*c* which is formed by drilling the tubular base 4*a* at an outer end portion (a pulley-side portion) of the bearing receiving portion 4*b*. The seal holding portion 4*c* is in a diameter-expanding shape having steps. The seal holding portion 4*c* receives or holds a seal member 76 formed in an annular shape, in the seal holding portion 4*c*.

The rear cover 5 includes a fitting convex portion 5*a* formed in a protruding manner from an end surface of rear cover 5 which faces the front body 2. This fitting convex portion 5*a* functions as the second plate member for fitting into the opening portion of one end of the tubular portion 3. Moreover, the rear cover 5 is formed with a bearing receiving portion 5*b* for housing and holding the second bearing 70*b*, at a substantially center portion of the fitting convex portion 5*a*. This bearing receiving portion 5*b* is formed in a concave shape, by drilling the rear cover 5 (by making a bottomed hole in the rear cover 5).

The bracket 6 includes a front plate 6*a* and a rear plate 6*b*. These front and rear plates 6*a*, 6*b* are formed integrally with each other to have a substantially H shape in longitudinal cross section. The front plate 6*a* is fixed to the front body 2, and the rear plate 6*b* is fixed to the rear cover 5. An axial length between the front plate 6*a* and the rear plate 6 (distance in x-axis direction of FIG. 1) is designed to be approximately equal to an axial length of the pump body 1. The bracket 6 supports the pump body 1 so as to sandwich both axially end surfaces of the pump body 1 between the front plate 6*a* and the rear plate 6*b*.

The front plate 6*a* is formed with a notch portion 6*c* in the form of a substantially half circle, as shown in FIG. 5. That is, the notch portion 6*c* is so cut as to avoid the position of tubular base 4*a*, at an upper end portion (a reservoir-tank-side end portion) of the front plate 6*a*. Moreover, the front plate 6*a* is formed with three bolt-insertion holes 6*d* each penetrating the front plate 6*a*, in an outer circumferential region of the notch portion 6*c*. These three bolt-insertion holes 6*d* are provided at 90° angle intervals in a circumferential direction of the half-circle shaped notch portion 6*c*. The front plate 6*a* is connected with the end wall portion 4 by three attachment bolts 72, so as to overlap with a lower half portion of the outer lateral surface of end wall portion 4. The three attachment bolts 72 are screwed into the end wall portion 4 through three bolt-insertion holes 6*d*.

On the other hand, an upper end side of the rear plate 6*b* is formed in a substantially triangle shape, and is formed with a bolt-insertion hole 6*e*, as shown in FIG. 6. The bolt-insertion hole 6*e* is located at a tip portion (corresponding to a top side) of the triangle shape. The rear plate 6*b* is connected with the rear cover 5 by one attachment bolt 72, so as to overlap with a lower end portion of the outer end surface of rear cover 5. The one attachment bolt 72 is screwed into the rear cover 5 through the bolt-insertion hole 6*e*.

The pulley 8 is connected with a boss member 9 by a plurality of bolts 73. The boss member 9 is formed in a substantially annular shape and is fixed to an outer circumferential surface of one end portion of the drive shaft 7 by means of press fitting. Hence, the pulley 8 is attached to the drive shaft 7 to prevent the relative rotation from occurring between the pulley 8 and drive shaft 7. Since the tubular base 4*a* is provided on the outside surface (pulley-side lateral surface) of the end wall portion 4, an axial space C between the pulley 8 and this outside surface (pulley-side lateral surface) of the end wall portion 4 is at least greater than a protrusion length (protruding amount) of the tubular base 4*a*.

The pump element 10 mainly includes an adapter ring 11, a cam ring 12, a rotor 13, and a pressure plate 14. The adapter ring 11 is formed in a substantially annular shape, and is fitted into an inner circumferential surface of the tubular portion 3. The cam ring 12 is formed in a substantially annular shape, and is placed on an inner circumferential side (inner-radius side) of the adapter ring 11 to be capable of swinging in left and right directions of FIG. 2. The rotor 13 is coupled with the drive shaft 7, and is placed on an inner circumferential side of the cam ring 12 to be capable of rotating. The pressure plate 14 is formed in a substantially disc shape, and is sandwiched between an end surface of the adapter ring 11 and an inner lateral surface (surface opposite to the pulley side, i.e., x-axis positive directional surface) of the end wall portion 4.

The adapter ring 11 is provided with a position-keeping pin 15, in a circular-arc-shaped groove (supporting groove) formed in a lower portion of inner circumferential surface of the adapter ring 11. The position-keeping pin 15 serves to keep a position of the cam ring 12. The adapter ring 11 holds a board member 16 functioning as a swing fulcrum of the cam ring 12. The board member 16 is located in a rectangular groove formed in the inner circumferential surface of the adapter ring 11 and on the left side (of FIG. 2) of the above-mentioned circular-arc-shaped groove, namely, formed adjacent to an after-mentioned first fluid pressure chamber P1.

The position-keeping pin 15 does not function as the swing fulcrum of the cam ring 12. This position-keeping pin 15 functions to keep the position of the cam ring 12 and to prevent a rotation of cam ring 12 relative to the adapter ring 11.

Figure 2:
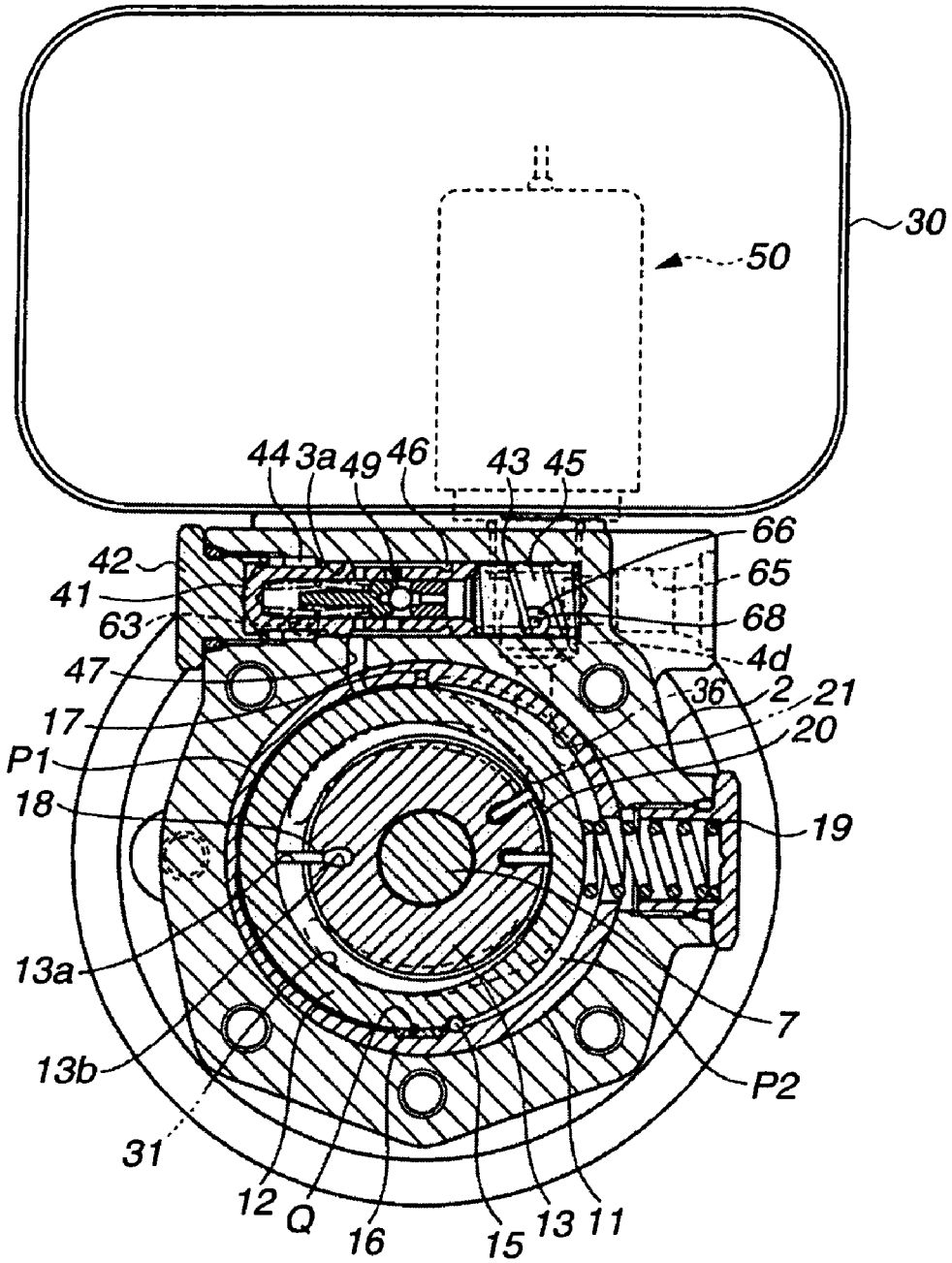
FIG. 2 is a cross-sectional view of FIG. 1, taken along a line A-A.

Moreover, a seal member 17 is provided in the inner circumferential surface of the adapter ring 11 and substantially at a position radially opposed to the board member 16. The seal member 17 is formed in a substantially rectangular shape in cross section as shown in FIG. 2 and is provided along the axial direction (x-axis direction of FIG. 1). The first fluid pressure chamber P1 is formed separately from a second fluid pressure chamber P2 by the board member 16 and the seal member 17, on the inner circumferential side of the adapter ring 11. The cam ring 12 is swingable toward the side of first fluid pressure chamber P1 or toward the side of second fluid pressure chamber P2, by using a predetermined point of an upper surface of the board member 16 as its swing center Q.

The rotor 13 is retained by an end surface of the fitting convex portion 5*a* of rear cover 5 and one end surface of pressure plate 14 under a substantially sandwiched condition. There is provided an axial slight clearance (gap in x-axis direction of FIG. 1) between the rotor 13 and the end surface of the fitting convex portion 5*a* of rear cover 5, and also there is provided an axial slight clearance (gap in x-axis direction of FIG. 1) between the rotor 13 and the one end surface of pressure plate 14. The rotor 13 rotates with a rotation of the drive shaft 7 in a counterclockwise direction of FIG. 2. An outer circumferential portion of the rotor 13 is formed with a plurality of slots 13*a*. The plurality of slots 13*a* are formed by cutting or notching the outer circumferential portion of rotor 13 in a radially inner direction of rotor 13. The plurality of slots 13*a* are provided at equal intervals in a circumferential direction of rotor 13. Each slot 13*a* receives or retains a vane 18 therein to allow the vane 18 to rise and fall in the radial direction of rotor 13. That is, each vane 18 can move in the outward and inward directions of the slot 13*a*, to abut on an inner circumferential surface of the cam ring 12. Each vane 18 is formed in a substantially rectangular-board shape. Each slot 13*a* is integrally connected with a back pressure chamber 13*b* which is provided at a radially-inner end of the slot 13*a*. Each back pressure chamber 13*b* continuously connected with the slot 13*a* is formed in a substantially circular shape in cross section.

A space between the cam ring 12 and the rotor 13 is divided into a plurality of pump chambers 20. That is, each pump chamber 20 is defined by adjacent two vanes 18. A volume of each pump chamber 20 is increased or decreased by swinging the cam ring 12 about the swing fulcrum Q.

In the second fluid pressure chamber P2, there is provided a spring 19 whose one end is elastically supported by a spring retainer formed in a bolt shape. The cam ring 12 is always biased or urged to the side of first fluid pressure chamber P1, namely in a direction bringing the volume of each pump chamber 20 to its maximum, by the spring 19.

In the end surface of the fitting convex portion 5*a* of rear cover 5, a first suction port 21 is provided as shown in FIGS. 1 and 2. The first suction port 21 is formed to cut the end surface of the fitting convex portion 5*a*, in an area (of the end surface of the fitting convex portion 5*a*) corresponding to a suction area (of the space between cam ring 12 and rotor 13) within which the volume of each pump chamber 20 becomes enlarged gradually with the rotation of the rotor 13. The first suction port 21 is formed in a substantially circular-arc shape in the circumferential direction as shown in FIG. 2. This first suction port 21 communicates or links with a first suction hole 23 at a center portion of the first suction port 21. The first suction hole 23 is formed in a penetrating manner to open into a suction passage 22. The suction passage 22 is formed in the rear cover 5 in a radial direction (y-axis direction of FIG. 1) as shown in FIG. 1. Working fluid (oil) introduced through the suction passage 22 from a reservoir tank 30 for storing working fluid is supplied through the first suction hole 23 into respective pump chambers 20.

On an inner end side (bottom side) of the bearing receiving portion 5*b* formed in the fitting convex portion 5*a*, a reflow passage 24 is formed to communicate with the suction passage 22. This reflow passage 24 is an oil passage for causing a working fluid which has leaked from the axial clearance (gap) between opposed surfaces of the rear cover 5 and the rotor 13 and has flowed into the bearing receiving portion 5*b*, to flow back to the suction passage 22. Thus, working fluid leaked from the above-mentioned axial clearance is again introduced to the first suction port 21.

The suction passage 22 has an opening end in an upper end portion (end portion in y-axis positive direction of FIG. 1) of the rear cover 5. The suction passage 22 has an inlet port 22*a* formed in somewhat diameter-expanding shape at this opening end portion. A connecting member 25 is provided at a bottom portion of the reservoir tank 30. A tubular portion 25*a* of the connecting member 25 projects from the bottom portion of reservoir tank 30 and is fitted into the inlet port 22*a* by insertion. Thereby, working fluid within the reservoir tank 30 is introduced through the tubular portion 25*a* to the suction passage 22.

The connecting member 25 includes a flange portion 25*b* which is formed in a substantially elliptical shape at one end portion of the tubular portion 25*a* formed in a substantially circular tube shape. A through hole 30*a* is formed to penetrate a substantially center portion of the bottom portion of the reservoir tank 30, and a tip side of the tubular portion 25*a* is inserted into the through-hole 30*a* so that the tubular portion 25*a* projects to an outside of the reservoir tank 30. Thereby, the flange portion 25*b* and the bottom portion of the reservoir tank 30 are fastened to an upper surface of the rear cover 5 by a pair of bolts 74 so as to sandwich the bottom portion of the reservoir tank 30 between the flange portion 25*b* and the upper surface of the rear cover 5, under the condition where the tubular portion 25*a* is fitted into inlet port 22*a* by insertion. That is, by means of the connecting member 25; an inside of the reservoir tank 30 is communicated with the suction passage 22, and also the reservoir tank 30 is fixed to the rear cover 5.

On the other hand, in an end surface of the pressure plate 14 which faces the rotor 13, a first discharge port 31 is provided as shown in FIGS. 1 and 2. The first discharge port 31 is formed to cut the end surface of the pressure plate 14, in an area (of the end surface of the pressure plate 14) corresponding to a discharge area (of the space between cam ring 12 and rotor 13) within which the volume of each pump chamber 20 becomes smaller gradually with the rotation of the rotor 13. The first discharge port 31 is located at a substantially axially-symmetric position against the first suction port 21, and is formed in a substantially arc shape in the circumferential direction as shown in FIG. 2. Moreover, a plurality of discharge holes 32 each communicating with the first discharge port 31 are formed to be connected with a discharge passage 33 formed to be open to the inner surface (lateral surface opposite to the pulley side) of the end wall portion 4 of front body 2. The discharge passage 33 introduces working fluid discharged from the discharge hole 32, to the external.

In the end surface of the pressure plate 14 which faces the rotor 13, a second suction port 26 is provided as shown in FIG. 1. The second suction port 26 is substantially in the same shape as the first suction port 21, and is formed so as to cut a portion of the end surface of the pressure plate 14 which faces the first suction port 21 through the rotor 13. This second suction port 26 communicates with a second suction hole 28 at a center portion of the second suction port 26. The second suction hole 28 is formed in a penetrating manner to open into a reflow passage 27. The reflow passage 27 is formed in the front body 2 as shown in FIG. 1. Thus, the second suction port 26 is communicated with the seal holding portion 4*c* through the reflow passage 27 and second suction hole 28.

In an inner end surface (surface opposite to the pulley side) of the seal holding portion 4*c* of the front body 2, a notch groove 29 is formed to cut a substantially center portion of the inner end surface of seal holding portion 4*c*. The notch groove 29 is in a substantially circular shape, and is formed to be open to the reflow passage 27 under the condition where the seal member 76 is held. The notch groove 29 cooperates with the reflow passage 27 and second suction hole 28 to define a sequence of oil passages. By means of this sequence of oil passages; a surplus oil (working fluid) in the seal member 76 is introduced to each pump chamber 20 of suction side in response to a pump sucking action, and thereby the surplus oil of the seal member 76 is prevented from leaking to the external.

Also in the end surface of the fitting convex portion 5*a* of rear cover 5, a second discharge port 34 is provided as shown in FIG. 1. The second discharge port 34 is substantially in the same shape as the first discharge port 31, and is formed so as to cut the end surface of the fitting convex portion 5*a* at a position facing the first discharge port 31 through the rotor 13. Accordingly, since the first and second suction ports 21 and 26 and the first and second discharge ports 31 and 34 are respectively provided to be symmetrical with respect to the rotor 13 in the axial direction, a pressure balance between axial both sides of each pump chamber 20 is kept properly.

Figure 3:
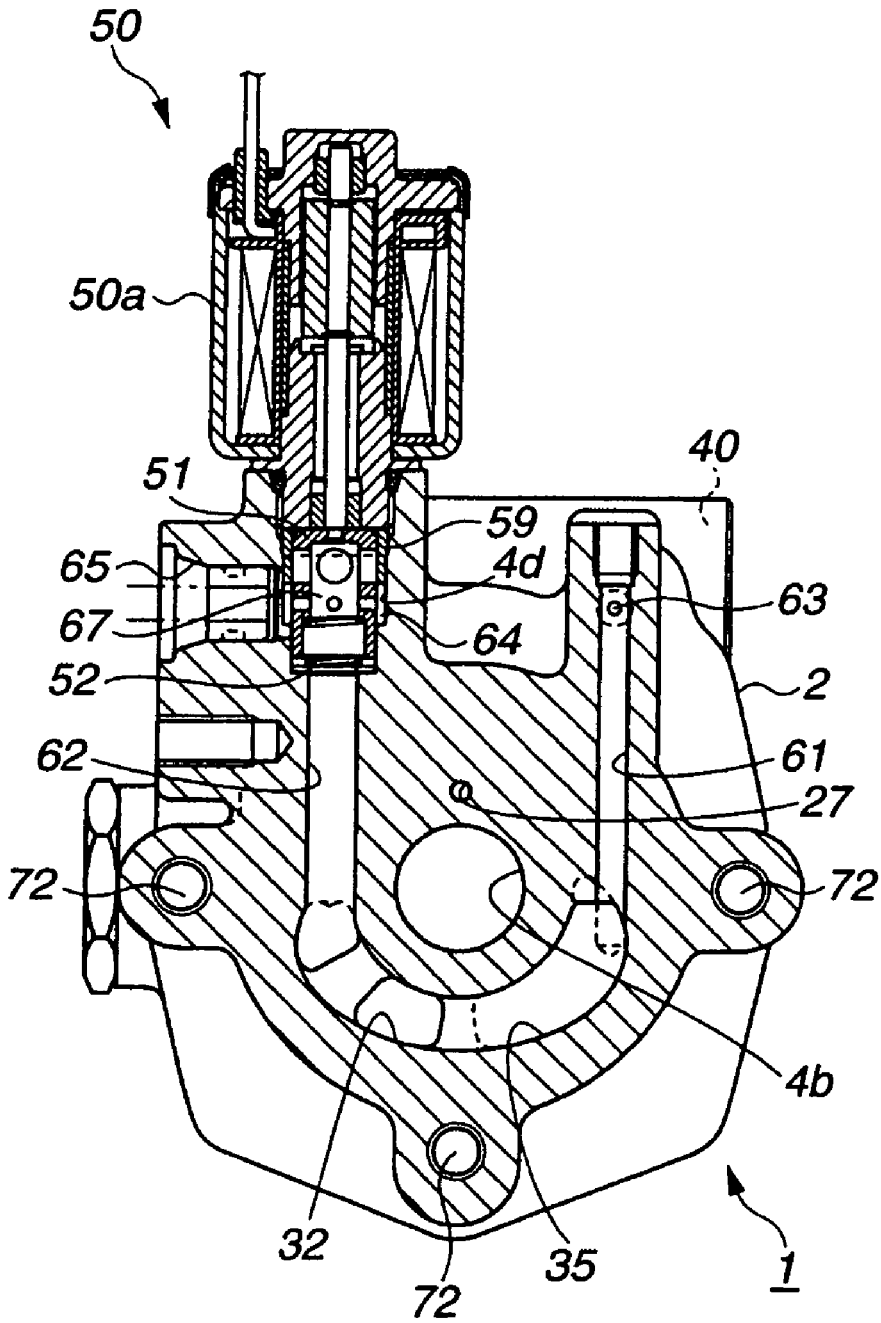
FIG. 3 is a cross-sectional view of FIG. 1, taken along a line C-C.

As shown in FIG. 3, the discharge passage 33 includes a pressure chamber 35, a first connecting passage 61 and a second connecting passage 62. The pressure chamber 35 is in the form of a substantially arc-shaped groove, and opens into the discharge hole 32. Through this pressure chamber 35, the discharge passage 33 is divided into two branches. The first connecting passage 61 is formed from one end side of the pressure chamber 35 along the y-axis of FIGS, and opens to (reaches) an upper end surface of the end wall portion 4. The first connecting passage 61 serves to introduce a part of working fluid within the pressure chamber 35 to a pressure chamber (an after-mentioned high pressure chamber 44) formed separately by the valving element 41 of the control valve 40. The second connecting passage 62 is formed from another end side of the pressure chamber 35 along the y-axis of FIGS, substantially in parallel with the first connecting passage 61. The second connecting passage 62 opens to the upper end surface of the end wall portion 4, and serves to introduce working fluid within the pressure chamber 35 to the external. At a terminal portion of the second connecting passage 62, the electromagnetic valve 50 is provided. The opening portion of the first connecting passage 61 is covered by a bolt or the like (not shown).

The control valve 40 is placed inside an upper end portion (tank-side end portion) of the tubular portion 3 of front body 2 along a direction (in z-axis direction of FIGS) perpendicular to the drive shaft 7, as shown in FIG. 1. As shown in FIGS. 2 and 3, the control valve 40 includes the valving element 41, a valve spring 43, the high pressure chamber 44 and a medium pressure chamber 45. The valving element 41 is slidably received or housed in a valve hole 3*a* formed inside the tubular portion 3. The valve spring 43 biases the valving element 41 in the left direction of FIG. 2, and thereby causes the valving element 41 to abut on the a plug 42 screwed in an opening end portion of the valve hole 3*a*. The high pressure chamber 44 is formed between both tip portions of the valving element 41 and the plug 42. The working fluid within the pressure chamber 35, namely, an upstream-side fluid pressure of an after-mentioned metering orifice 60 formed by the electromagnetic valve 50 is introduced through the first connecting passage 61 into the high pressure chamber 44. The medium pressure chamber 45 houses the valve spring 43. A downstream-side fluid pressure of the metering orifice 60 is introduced into the medium pressure chamber 45. When a pressure difference between the high pressure chamber 44 and the medium pressure chamber 45 becomes greater than a predetermined level, the valving element 41 moves in the right direction of FIG. 2 against a biasing force of the valve spring 43.

At a connecting portion between the first connecting passage 61 and the high pressure chamber 44, a first orifice 63 is formed in a diameter-reducing shape. This first orifice 63 serves to reduce an influence due to a pressure pulsation of working fluid to be introduced into the high pressure chamber 44, and also has a function of dumping a fluid vibration of the valving element 41.

When the valving element 41 is positioned in its left side as shown in FIG. 2, the first fluid pressure chamber P1 is connected with a low pressure chamber 46 through a communicating fluid passage 47 communicating the first fluid pressure chamber P1 with the valve hole 3*a*. The low pressure chamber 46 is separately formed on an outer circumferential (peripheral) side of the valving element 41. This low pressure chamber 46 is connected with a low pressure passage 48 formed dividedly from the suction passage 22, as shown in FIG. 1. Hence, low-pressure working fluid is introduced from the suction passage 22 through the low pressure passage 48 into the first fluid pressure chamber P1.

On the other hand, when the valving element 41 has slid to the right side of FIG. 2 according to the pressure difference between the high pressure chamber 44 and the medium pressure chamber 45; the communication between the first fluid pressure chamber P1 and the low pressure chamber 46 is blocked, and the first fluid pressure chamber P1 is communicated with the high pressure chamber 44. Accordingly, high-pressure working fluid is introduced into the first fluid pressure chamber P1. Thus, one fluid pressure selected from the pressure of low pressure chamber 46 and the upstream-side pressure of metering orifice 60 is supplied into the first fluid pressure chamber P1.

Figure 11:
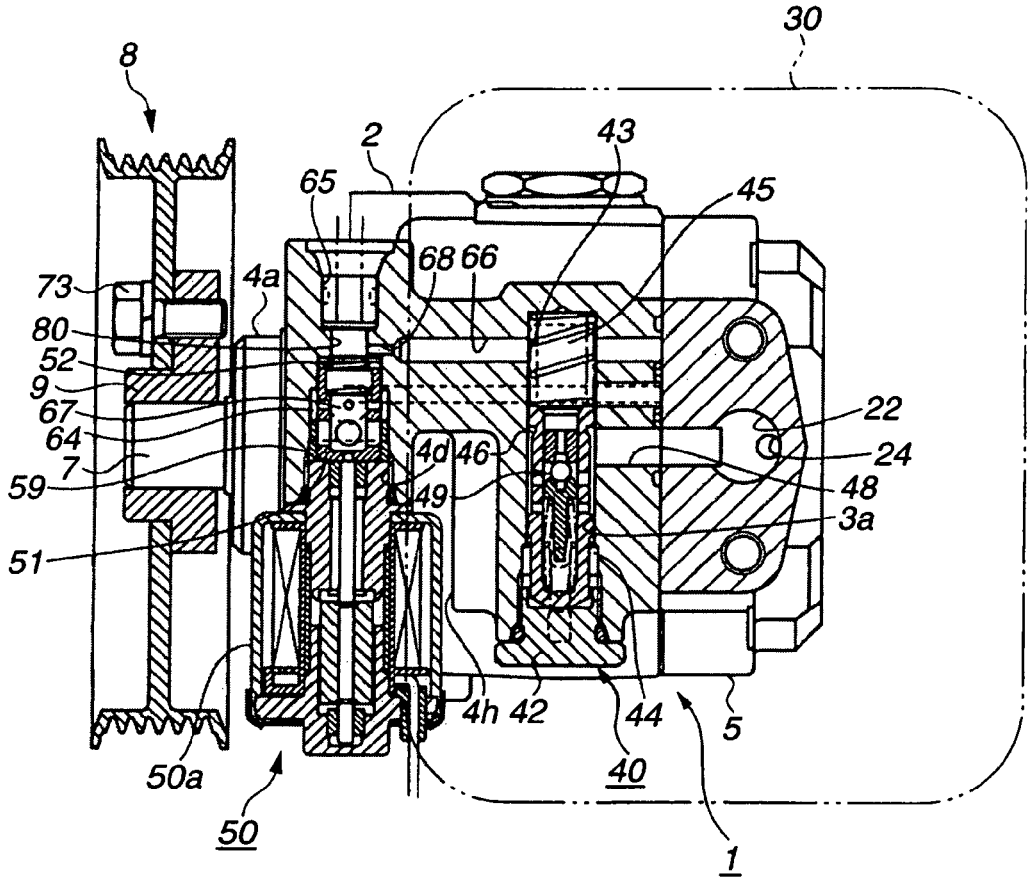
FIG. 11 is a cross-sectional view of FIG. 9, taken along a line H-H.

The control valve 40 includes a relief valve 49 inside the valving element 41, as shown in FIGS. 2 and 11. When the pressure of the medium pressure chamber 45 reaches a predetermined value or more, namely when a load-side pressure (a pressure on the side of the power steering system) reaches the predetermined value or more; the relief valve 49 is released or opened and thereby a part of working fluid (of the medium pressure chamber 45) is made to flow back to the suction passage 22 through the low pressure passage 48.

The second fluid pressure chamber P2 communicates with the suction passage 22 through a communicating passage 37 linked to a suction-pressure introduction port 36, as shown in FIGS. 1 and 2. The suction-pressure introduction port 36 is formed to open into the second fluid pressure chamber P2, and is formed in a substantially arc shape. The suction-side fluid pressure (low pressure) is always introduced into the second fluid pressure chamber P2. That is, the cam ring 12 is always pressed to the side of the first fluid pressure chamber P1 by the suction-side fluid pressure and the biasing force of the spring 19.

Figure 7:
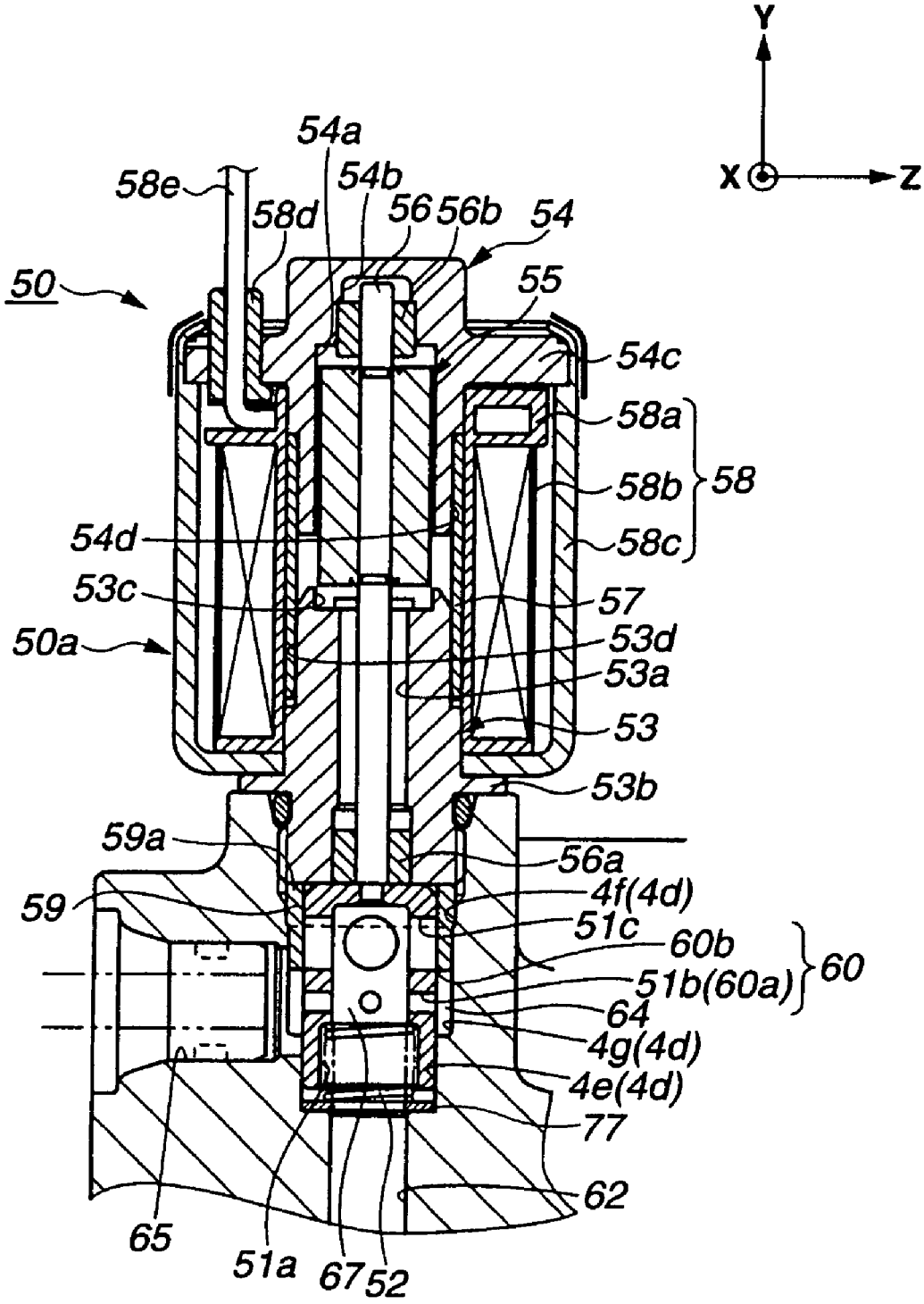
FIG. 7 is a partial enlarged view of FIG. 3, showing a state of a metering orifice when no magnetizing current is passing through an electromagnetic valve in the first embodiment.

The electromagnetic valve 50 is placed on a side of the inlet port 22*a* (i.e., on a suction-area side) opposite to a side of the discharge ports 31 and 34 (i.e., a discharge-area side) when regarding the drive shaft 7 as a boundary of these sides, as shown in FIGS. 1, 2 and 7. The electromagnetic valve 50 is provided between the pulley 8 and the control valve 40, and is arranged along an extending direction of the second connecting passage 62 (in y-axis direction of FIGS. 1 and 7).

The electromagnetic valve 50 mainly includes a valving element 51, a return spring 52 and an electromagnetic unit 50*a*. The valving element 51 is received or housed to be movable in an axial direction of electromagnetic valve 50 (in y-axis direction of FIGS. 1 and 7) inside a valve hole 4*d*. The valve hole 4*d* is formed on the second connecting passage 62 (i.e., at some point of the second connecting passage 62) inside the end wall portion 4 of front body 2 constituting a valve body of the electromagnetic valve 50. The valve hole 4*d* is formed to open in the upper direction of the end wall portion 4 (in y-axis positive direction of FIGS. 1 and 7). The return spring 52 is seated on an annular spacer 77 received inside the valve hole 4*d*, and biases the valving element 51 to the side of opening end of the valve hole 4*d*. The electromagnetic unit 50*a* is provided along the extending direction of the valve hole 4*d* so as to cover or close the valve hole 4*d*. The electromagnetic unit 50*a* functions to vary a holding position of the valving element 51 inside the valve hole 4*d* against the biasing force of return spring 52, by moving forward an after-mentioned rod 56 with a power energization.

The valve hole 4*d* is formed in a diameter-expanding shape having steps toward the side of opening end, to include three portions each having an inside diameter different from one another. That is, the valve hole 4*d* is constituted by a small-diameter portion 4*e*, a large-diameter portion 4*f* and a middle-diameter portion 4*g*. The small-diameter portion 4*e* has an inside diameter substantially equal to an outside diameter of the valving element 51, and slidably holds one end side of the valving element 51. The large-diameter portion 4*f* is formed at the opening end portion of the valve hole 4*d*, and is formed with a female thread (internal thread) portion within a predetermined range from the opening end. One end portion of an after-mentioned first core 53 of the electromagnetic unit 50*a* is screwed into the female thread portion. The middle-diameter portion 4*g* is formed between the large-diameter portion 4*f* and the small-diameter portion 4*e*.

Moreover, in the valve hole 4*d*, a holding member 59 is provided across the middle-diameter portion 4*g* and the large-diameter portion 4*f*, namely, is in contact with the middle-diameter portion 4*g* and the large-diameter portion 4*f*. The holding member 59 is formed to have an inside diameter substantially equal to the outside diameter of the valving element 51, and slidably holds another end portion of the valving element 51. This holding member 59 includes an expanded-diameter portion 59*a* on one end side of the holding member 59. The expanded-diameter portion 59*a* is formed to have an outside diameter substantially equal to the inside diameter of the large-diameter portion 4*f*. The expanded-diameter portion 59*a* is supported under the condition where the expanded-diameter portion 59*a* is sandwiched between one end surface of the first core 53 and a step portion formed at a boundary of the large-diameter portion 4*f* and middle-diameter portion 4*g*.

In the middle-diameter portion 4*g* of the valve hole 4*d*, an annular (circular) passage 64 is formed or partitioned on an outer peripheral side of the valving element 51 by means of the holding member 59. That is, an inner surface of the middle-diameter portion 4*g* of the valve hole 4*d* cooperates with an outer circumferential surface of the valving element 51 and the holding member 59 to define the annular passage 64. This annular passage 64 communicates through an outlet port 65 with the external. The outlet port 65 is formed along the radial direction of electromagnetic valve 50 to open to the outside surface of the end wall portion 4. Moreover, the annular passage 64 communicates with the medium pressure chamber 45 of control valve 40 through a communicating passage 66. The communicating passage 66 is formed linearly toward the side of the control valve 40 (in x-axis positive direction of FIG. 1).

Figure 8:
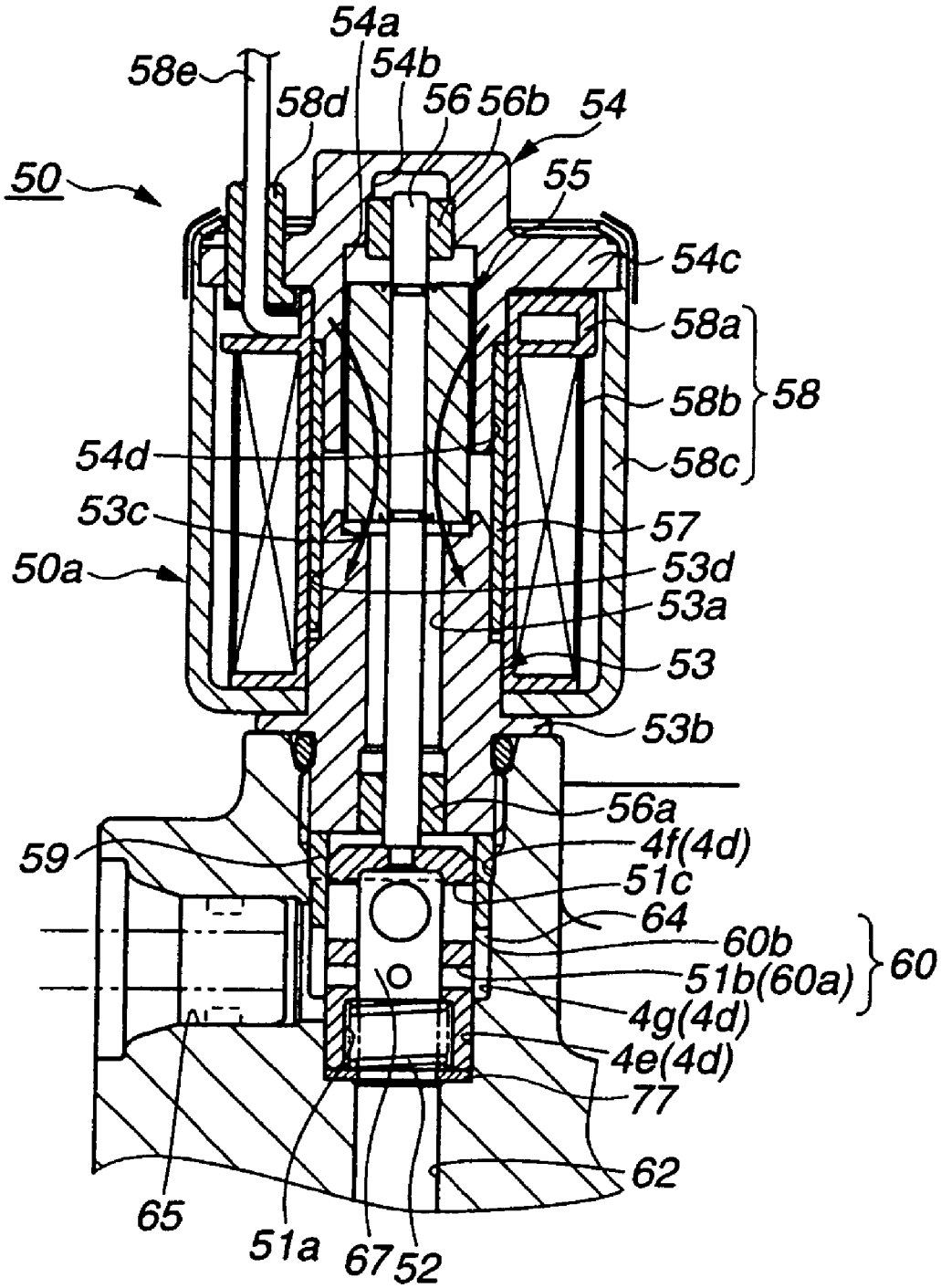
FIG. 8 is a partial enlarged view of FIG. 3, showing a state of the metering orifice when the magnetizing current is passing through the electromagnetic valve in the first embodiment.

The valving element 51 is in a substantially (cylindrical) tubular shape having its cover, and is placed to open to an end portion side of the second connecting passage 62. On this opening end side of the valving element 51, a second pressure chamber 67 is defined by the spacer 77 and a space within the valving element 51. That is, the valving element 51 cooperates with the spacer 77 to form the second pressure chamber 67. Moreover, in an inner circumferential portion of this opening end portion of the valving element 51, an expanded-diameter portion 51*a* is formed in a diameter-expanding step shape. This expanded-diameter portion 51*a* has an inside diameter slightly larger than an outside diameter of the return spring 52, as shown in FIGS. 7 and 8. One end side of the return spring 52 is housed and held in the expanded-diameter portion 51*a*, and the return spring 52 is supported by being sandwiched between an inner surface (upper surface) of the spacer 77 and an inner end surface (diameter-expanding step) of the expanded-diameter portion 51*a*.

The valving element 51 is formed with four small-diameter holes 51*b* at an axially predetermined portion of one end side of the valving element 51, and at 90° angle intervals in a circumferential direction of valving element 51. Each small-diameter hole 51*b* penetrates the valving element 51 in a radial direction of the valving element 51 to communicate the annular passage 64 with the second pressure chamber 67. These small-diameter holes 51*b* cause the second pressure chamber 67 to be always open to the annular passage 64 irrespective of the holding position of the valving element 51 inside the valve hole 4*d*. Hence, the small-diameter holes 51*b* define a fixed orifice 60*a* for reducing a working fluid pressure (pump discharge pressure) to be introduced from the second pressure chamber 67 into the annular passage 64.

On the other hand, the valving element 51 is formed with four large-diameter holes 51*c* at an axially predetermined portion of another end side of the valving element 51, and at 90° angle intervals (at same circumferential positions as the small-diameter holes 51*b*) in the circumferential direction of valving element 51. Each large-diameter hole 51*c* penetrates the valving element 51 in the radial direction of the valving element 51, and is capable of communicating the annular passage 64 with the second pressure chamber 67. These large-diameter holes 51*c* are just closed or blocked by an inner circumferential surface of an opening end portion of the holding member 59, when the holding position of the valving element 51 is in its uppermost position (its upper limit position) inside the valve hole 4*d* as shown in FIG. 7. As the valving element 51 moves downward (in y-axis negative direction of FIG. 7), the opening area (of the second pressure chamber 67) to the annular passage 64 becomes gradually greater.

That is, the opening area (of the second pressure chamber 67) to the annular passage 64 is varied according to the holding position of the valving element 51 inside the valve hole 4*d*, i.e., according to a positional relationship between the large-diameter holes 51*c* and the holding member 59. The large-diameter holes 51*c* are designed to cause the second pressure chamber 67 to be open to the annular passage 64 with a predetermined slight area, even when the holding position of the valving element 51 is in its lowermost position as shown in FIG. 8. Hence, large-diameter holes 51*c* define a variable orifice 60*b* for reducing the pump discharge pressure to be introduced from the second pressure chamber 67 into the annular passage 64, by means of a variation of cross-sectional area of flow passage based on the above-mentioned variation of opening area.

Thus, the fixed orifice 60*a* cooperates with the variable orifice 60*b* to define the above-mentioned metering orifice 60. The metering orifice 60 constituted by the fixed orifice 60*a* and variable orifice 60*b* exists between the second pressure chamber 67 and the annular passage 64, i.e., at a boundary of upstream and downstream of the electromagnetic valve 50. The metering orifice 60 variably controls the pump discharge pressure introduced through the second connecting passage 62, by means of the electromagnetic unit 50*a*.

The electromagnetic unit 50*a* includes the first core 53, a second core 54, an armature 55, the rod 56, a connecting member 57 and a coil unit 58. The first core 53 is screwed into the opening end portion of the valve hole 4*d*, and is formed with a through hole 53*a* passing through the first core 53 along its center axis. The second core 54 is provided coaxially with the first core 53, and faces another end side of the first core 53 to have a predetermined axial space between the second core 54 and the first core 53. The second core 54 is formed with a receiving hole 54*a* which is provided so as to drill the second core 54 along the center axis from an end side of second core 54 that faces to the first core 53. The armature 55 is in a tubular (cylindrical) shape, and is received by the receiving hole 54*a* to be movable into or from the receiving hole 54*a*. The rod 56 is passed through the armature 55, and is movable integrally with this armature 55. The rod 56 is housed in both of the through hole 53*a* and the receiving hole 54*a*. The connecting member 57 is attached to be fitted over both outer circumferential surfaces of the inter-opposed end portions of the first and second cores 53 and 54, and thereby connects the end portion of the first core 53 with the end portion of the second core 54. The coil unit 58 is provided to surround an outer circumferential region of the connecting member 57 and the inter-opposed end sides of the first and second cores 53 and 54.

The first core 53 is formed of magnetic material, and in a substantially tubular (cylindrical) shape. An outer periphery of one end portion of the first core 53 is formed with a male (external) thread portion for being screwed into the female thread portion of the end wall portion 4. The first core 53 includes a flange portion 53*b* on an outer periphery of one end side of the first core 53. Under an assembled state; the upper end surface of the end wall portion 4 abuts on one side surface of the flange portion 53*b*, and a lower end portion of the coil unit 58 is seated on another side surface of the flange portion 53*b*. Between the flange portion 53*b* and the male thread portion, a sealing groove is formed in a cutting manner. A seal member is attached to the sealing groove to be fitted in the sealing groove, and thereby seals the opening portion of the valve hole 4*d* under the assembled state. On an inner periphery of one end portion of the first core 53, a supporting member 56*a* rotatably supporting one end portion of the rod 56 is received.

The first core 53 is formed with a concave portion 53*c* on an inner periphery of another end portion of the first core 53, namely at an upper opening of the through hole 53*a*. The concave portion 53*c* is provided by drilling the inner periphery of the another end portion of the first core 53, to have an inside diameter substantially equal to an inside diameter of the receiving hole 54*a* of second core 54. When the armature 55 moves downward (toward the drive shaft 7), one end portion of the armature 55 is slidably fitted into the concave portion 53*c*. Moreover, the first core 53 is formed with a fitting groove 53*d* in an outer circumferential surface of the another end portion of the first core 53. The fitting groove 53*d* is formed in a diameter-reducing step shape, and one end side of the connecting member 57 is fitted over the fitting groove 53*d*.

The second core 54 is formed of magnetic material, and in a substantially tubular (cylindrical) shape having its cover. At an inner end portion (upper end portion of FIGS) of the receiving hole 54*a*, a concave portion 54*b* is formed to drill the second core 54. The concave portion 54*b* is in a diameter-reducing step shape from the receiving hole 54*a*. A supporting member 56*b* rotatably supporting another end portion of the rod 56 is received in the concave portion 54*b*. Moreover, the second core 54 includes a flange portion 54*c* on an outer periphery of another end side of the second core 54. One end portion of an after-mentioned yoke 58*c* of the coil unit 58 is fixedly caulked to an outer-circumferential end (at a radially outer edge) of one side of the flange portion 54*c*. Moreover, the second core 54 is formed with a fitting groove 54*d* in an outer circumferential surface of one end portion (lower end portion of FIGS) of the second core 54. The fitting groove 54*d* is formed in a diameter-reducing step shape, and another end side of the connecting member 57 is fitted over the fitting groove 54*d*.

The armature 55 is formed of magnetic material, and is received in the receiving hole 54*a* of the second core 54 with a slight radial clearance between the armature 55 and the receiving hole 54*a*. The armature 55 is moved toward the first core 53 by means of an attractive force caused based on an after-mentioned excitation operation of the coil unit 58.

The rod 56 is formed in a substantially pole shape. A length of the rod 56 is designed such that a (lower) tip surface of the rod 56 and one end surface (lower end surface in FIGS) of first core 53 are in the same plane under the state where the armature 55 is in its uppermost position as shown in FIG. 7. According to a forward movement of the armature 55, the rod 56 is made to project from the lower end surface of first core 53 so that the valving element 51 is pushed downwardly (in y-axis negative direction of FIG. 7).

The connecting member 57 is formed of nonmagnetic material, and in a thin-walled tubular shape. The connecting member 57 is fixed by a welding under the condition where the connecting member 57 is fitted over both of the fitting grooves 53*d* and 54*d* of the first and second cores 53 and 54.

The coil unit 58 mainly includes a bobbin 58*a*, a coil 58*b* and the yoke 58*c*. The bobbin 58*a* is formed in a substantially tubular (cylindrical) shape having both-end flange portions. The bobbin 58*a* is attached to the inter-opposed end portions of the first and second cores 53 and 54 so as to be fitted over the radially-outer peripheries of the inter-opposed end portions of the first and second cores 53 and 54. The coil 58*b* is wound around an outer circumferential surface of the bobbin 58*a*. The yoke 58*c* is formed in a substantially tubular shape, and cooperates with the coil 58*b* to surround an (radially-) outer peripheral side of the bobbin 58*a*. The coil 58*b* is connected with a harness 58*e* which is drawn through a grommet 58*d* from an electronic controller (not shown). The grommet 58*d* is provided to pass through the flange portion 54*c* of the second core 54.

In the case that an exciting current (magnetizing current) is not passing through the coil 58*b*, the state where the valving element 51 is in contact with the lower end surface of first core 53 is maintained by means of the spring force of return spring 52 since the attractive force toward the first core 53 is not applied to the armature 55. Hence, in this case, only the respective small-diameter holes 51*b* are open to the annular passage 64 while the respective large-diameter holes 51*c* are closed (blocked) by the holding member 59. That is, the second pressure chamber 67 is communicated with the annular passage 64 through only the respective small-diameter holes 51*b*.

Accordingly, in this case, working fluid which has flowed through the second connecting passage 62 into the radially-inner space of the valving element 51 is introduced through the fixed orifice 60*a* into the annular passage 64. Then, this working fluid which has flowed into the annular passage 64 is divided into two parts. One part of this working fluid is introduced through the communicating passage 66 into the medium pressure chamber 45 of control valve 40, and the residual part of this working fluid is delivered though the outlet port 65 to the external.

On the other hand, in the case that the exciting current is passing through the coil 58*b*, a magnetic field directed from the side of second core 54 toward the side of first core 53 is generated as shown in arrows of FIG. 8. Accordingly, the attractive force attracting the armature 55 to the side of first core 53 is caused so that the armature 55 moves toward the first core 53. Thereby, the rod 56 moves in the downward direction of FIG. 8, and the valving element 51 moves in the downward direction against the biasing force of return spring 52 by means of the pressing force (suppressing force) of the rod 56 based on the attractive force. Accordingly, the second pressure chamber 67 is communicated with the annular passage 64 through both of the respective small-diameter holes 51*b* and the respective large-diameter holes 51*c*.

Accordingly, in this case, working fluid which has flowed through the second connecting passage 62 into the radially-inner space of the valving element 51 is introduced through the fixed orifice 60*a* and the variable orifice 60*b* into the annular passage 64. Therefore, the discharge pressure to be introduced into the medium pressure chamber 45 of control valve 40 and also to the external is lower than that in the case where the variable orifice 60*b* is closed as mentioned above.

As a result, while the pump discharge pressure to be delivered to the load side is reduced, the working-fluid pressure to be introduced into the medium pressure chamber 45 is also reduced. Accordingly, the pressure difference between the high pressure chamber 44 and the medium pressure chamber 45 in the control valve 40 increases so that the cam ring 12 is adjusted to reduce an eccentric degree of the cam ring 12. Thereby, an amount of pump discharge itself is reduced.

The communicating passage 66 is formed to pass from the middle-diameter portion 4*g* of the valve hole 4*d* through the valve hole 3*a* for the control valve 40. One end of the communicating passage 66 is open to the end surface of tubular opening of the front body 2 (i.e., reaches the front body 2's end surface opposite to the pulley side). This opening end of the communicating passage 66 is blocked by the rear cover 5. In another end portion of the communicating passage 66, a second orifice 68 is formed so as to be open to (communicate with) the valve hole 4*d* in a diameter-reducing step shape, namely in a shape reducing a diameter of the communicating passage 66 in step wise.

As mentioned above, the electromagnetic unit 50*a* is arranged to protrude upward from the pump body 1 as shown in FIG. 1. Accordingly, the reservoir tank 30 is not formed in a rectangular shape in cross section (on a plane perpendicular to the axial direction of electromagnetic valve 50), but is formed in an irregular cross-sectional shape to have a depressed portion (cutout portion) 30*b*, as shown in FIG. 4. This depressed portion 30*b* is formed to avoid an installation position of the electromagnetic unit 50*a*. By virtue of the depressed portion 30*b*, the reservoir tank 30 can secure its necessary storage capacity (accumulation amount of fluid) without causing an interference with the electromagnetic unit 50*a* in achieving a compact layout.

In this embodiment according to the present invention, the electromagnetic valve 50 is placed between the pulley 8 and the control valve 40 in the axial direction of the drive shaft 7. An inside of the end wall portion 4 of front body 2 corresponding to the region axially between the pulley 8 and the control valve 40 is formed with no fluid passage generally in the other technologies of pump apparatus. In this embodiment, this available area can be effectively used.

In other words, there is a low possibility that the upper end portion of the outer side of the end wall portion 4 at which the electromagnetic valve 50 is installed has a restriction of layout when mounting the pump, since the case where the other structural components or the like are provided near this upper end portion of end wall portion 4 is rare because of a belt winding around the pulley 8. Hence, this upper portion of end wall portion 4 is a region capable of securing a degree of freedom in layout most greatly. Accordingly, a general versatility of the structure according to this embodiment is also favorable.

Moreover, in this embodiment, the bracket 6 is arranged on the discharge-area side of the pump body 1 which is relatively easy to be deformed due to the pump discharge pressure, and the electromagnetic valve 50 is disposed on the opposite side of the bracket 6 relative to the drive shaft 7. Accordingly, the bracket 6 suppresses the deformation in the portion of the pump body 1 which corresponds to the discharge region. Also, the bracket 6 formed in a predetermined size necessary to ensure a rigidity for suppressing such a deformation does not interfere with the electromagnetic valve 50 so that the degree of freedom in layout of electromagnetic valve 50 can be secured sufficiently. The bracket 6 is fixed to the both end portions of the pump body 1 through the respective plates 6*a* and 6*b* thereof, and thereby firmly supports the pump body 1 to sandwich the pump body 1 between the respective plates 6*a* and 6*b*. Hence, a variation of belt tension and a variation of internal pressure of each pump chamber 20 which are applied to the pulley 8 can be suppressed more effectively.

In other words, the electromagnetic valve 50 is located on the pump body 1's side on which the inlet port 22*a* is formed, namely on the side on which the reservoir tank 30 is disposed. Accordingly, substantially all the structural components to be installed to protrude from the pump body 1 can be installed collectively on one surface side, except the bracket 6. Hence, a mounting performance of the pump (apparatus) can be improved.

The electromagnetic unit 50*a* of the electromagnetic valve 50 is provided to overlap with the reservoir tank 30 in the extending direction of the drive shaft 7 (in x-axis direction of FIG. 1). Accordingly, by only forming the depressed portion 30*b*, an outer peripheral vicinity of the electromagnetic unit 50*a* protruding from the upper end surface of the front body 2 can be used as a volume chamber of the reservoir tank 30. Hence, the volume of the reservoir tank 30 can be sufficiently secured.

Further, the control valve 40 is sandwiched axially between the inlet port 22*a* (suction passage 22) and the electromagnetic valve 50, in addition to the above-mentioned arrangement where the electromagnetic valve 50 is placed between the pulley 8 and the control valve 40 on the side of inlet port 22*a* in the pump body 1. Accordingly, a passage length of the low pressure passage 48 connecting the control valve 40 with the suction passage 22 and a passage length of the communicating passage 66 connecting the control valve 40 with the electromagnetic valve 50 can be most shortened. Hence, a loss due to a flow resistance can be reduced at the time of flow of working fluid.

Further, in this embodiment, the electromagnetic valve 50 is placed in a so-called vertical posture, and the valve hole 4*d* is formed along the extending line of the second connecting passage 62 (i.e., an axially center line of valve hole 4*d* is substantially same as the extending line of second connecting passage 62) in order to place the electromagnetic valve 50. Accordingly, the valve hole 4*d* can be produced together with the second connecting passage 62, that is, the both of valve hole 4*d* and second connecting passage 62 can be produced by one series of manufacturing processing. Hence, the complication of a processing workability which is caused due to an additional process for the valve hole 4*d* can be suppressed to a minimum, and thereby the rise of a manufacturing cost can be suppressed.

Further, the communicating passage 66 is provided from the valve hole 4*d* to be open to the opening end surface of the front body 2 (to reach the right end surface of the front body 2 in FIG. 1). Accordingly, this communicating passage 66 can be easily produced by means of a drill process or the like, from the opening end surface of the front body 2. Moreover, since the second orifice 68 is provided at the connecting portion between the communicating passage 66 and the valve hole 4*d*, namely at the inner end portion of the communicating passage 66; the communicating passage 66 and second orifice 68 can be produced only by means of a hole-making process such as drill process, from the opening end side (the right end side) of the front body 2. Therefore, the processing workability is remarkably enhanced. By virtue of such a structure, it is also possible that both of the communicating passage 66 and second orifice 68 are formed simultaneously by means of just one-time drill or the like from the opening end side of the front body 2.

Further, in this embodiment, the electromagnetic valve 50 is connected through the communicating passage 66 with the control valve 40, and the electromagnetic valve 50 controls the pump discharge pressure which is applied to the medium pressure chamber 45 of the control valve 40 but does not directly control the control valve 40. That is, the electromagnetic valve 50 indirectly controls the control valve 40 by controlling the pressure difference of two pump discharge pressures which respectively act on the high pressure chamber 44 and the medium pressure chamber 45. Accordingly, the electromagnetic valve 50 (electromagnetic unit 50*a*) for being used for this indirect control does not need a great driving force, so that a size of the electromagnetic valve 50 (electromagnetic unit 50*a*) can be downsized to a minimum. Also by virtue of the employment of such a control method, the degree of freedom in layout of the electromagnetic valve 50 is increased.

Second Embodiment

FIGS. 9 to 14 show a second embodiment according to the present invention. The second embodiment is based on the structure of the first embodiment. In the second embodiment, the electromagnetic valve 50 is placed in a so-called horizontal posture, although the electromagnetic valve 50 is placed in the vertical posture in the first embodiment. Hence, different parts as compared with the first embodiment will be explained below.

Figure 9:
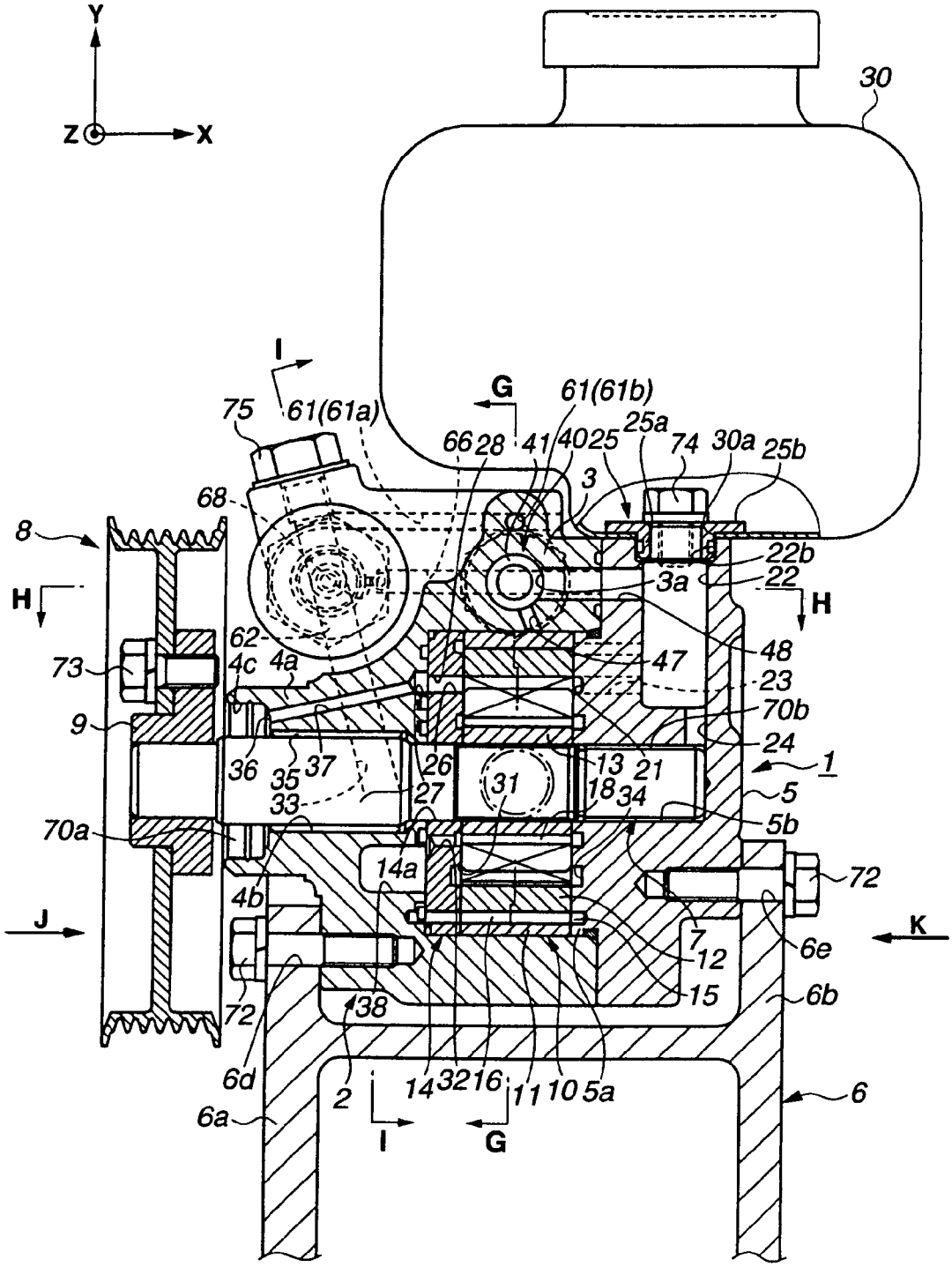
FIG. 9 is a vertical cross-sectional view showing a schematic structure of a second embodiment of the pump apparatus according to the present invention.
Figure 12:
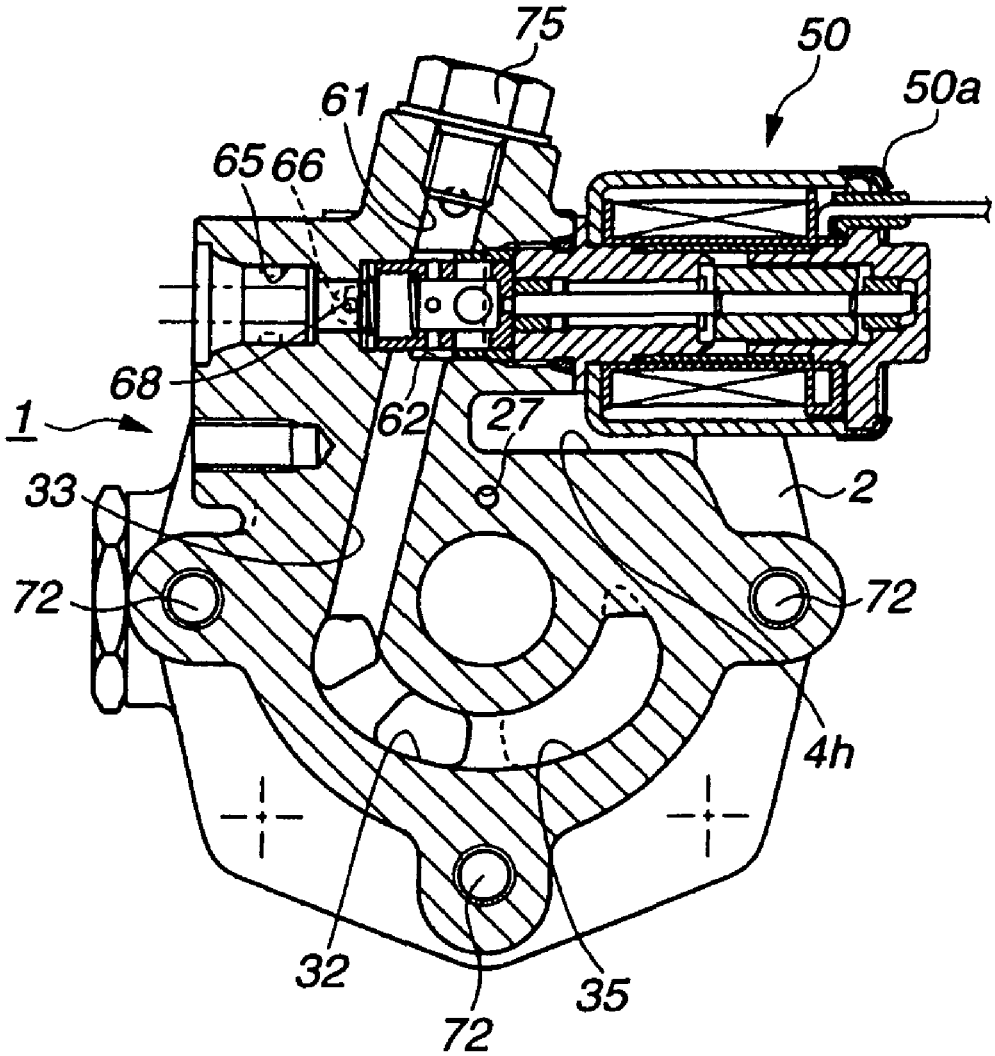
FIG. 12 is a cross-sectional view of FIG. 9, taken along a line I-I.
Figure 13:
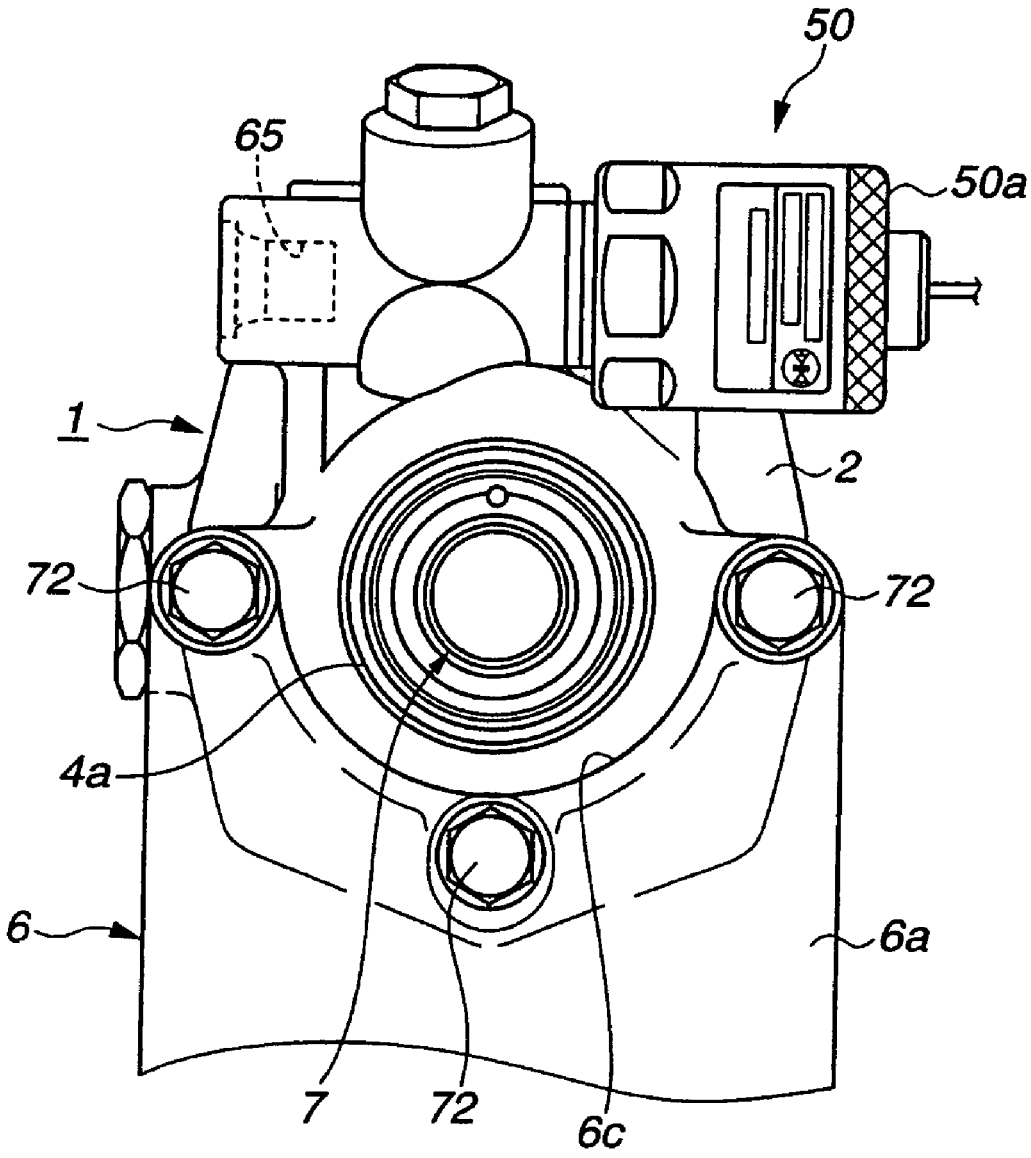
FIG. 13 is a side view of FIG. 9 as seen in a direction of an arrow J.
Figure 14:
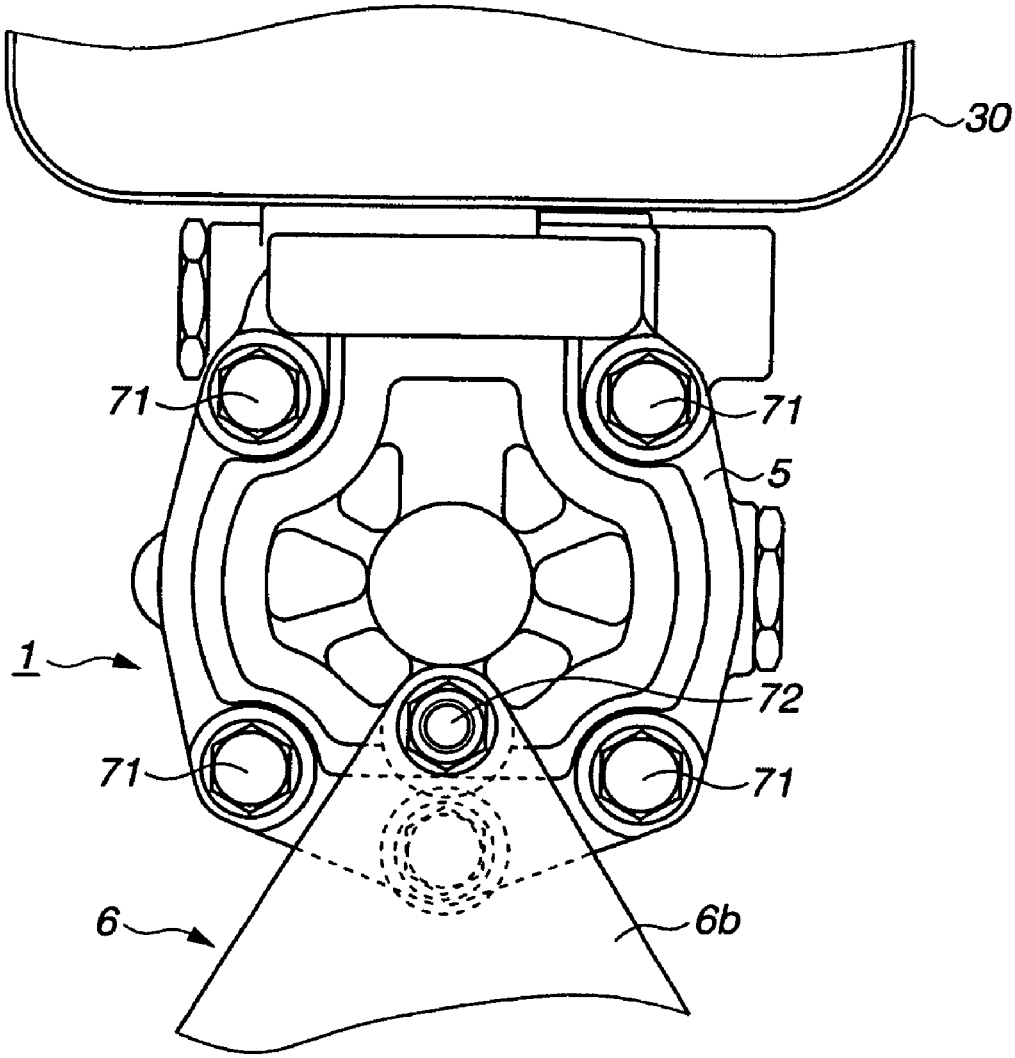
FIG. 14 is a side view of FIG. 9 as seen in a direction of an arrow K.

In a pump apparatus according to the second embodiment, as shown in FIGS. 9, 11 and 12, the electromagnetic valve 50 is located at an upper end portion of the end wall portion 4 of front body 2 and is located between the pulley 8 and the control valve 40. (A longitudinal direction of) The electromagnetic valve 50 is placed in parallel with (a longitudinal direction of) the control valve 40. In other words, the electromagnetic valve 50 according to the second embodiment is provided in such a state that the electromagnetic valve 50 according to the first embodiment has been rotated by 90 degrees in the rotational direction of the rotor 13. The electromagnetic unit 50*a* is provided to protrude in a wall-side direction (z-axis direction) of the end wall portion 4, namely protrude in an extending direction of the valve hole 4*d* which is formed to be open in a direction in which the valve hole 3*a* of control valve 40 is open. That is, the valve hole 4*d* in the second embodiment has an opening end in the same direction as that of the valve hole 3*a*.

Particularly as shown in FIG. 12, the end wall portion 4 of front body 2 is formed with a depressed portion (cutout portion) 4*h* at a right upper end portion of FIG. 12 of the end wall portion 4. The depressed portion 4*h* is formed to avoid the installation position of the electromagnetic unit 50*a* protruding in the horizontal direction of front body 2.

The valve hole 4*d* is provided coaxially with the outlet port 65 as shown in FIG. 12. Moreover, the valve hole 4*d* is provided to have its center line at the same vertical level as that of the valve hole 3*a* of control valve 40 (i.e., both radial centers of holes 4*d* and 3*a* are on an identical x-axis directional line of FIG. 9) as shown in FIG. 9.

In accordance with this arrangement change of the electromagnetic valve 50 in the second embodiment, the discharge passage 33 extends only from another end portion of the pressure chamber 35 toward an inner end side of the valve hole 4*d* as shown in FIGS. 9, 11 and 12, is although the discharge passage 33 is divided into two branches from the pressure chamber 35 in the first embodiment. Then, the discharge passage 33 is divided into two branches (first and second connecting passages 61 and 62) just before the valve hole 4*d*. The first connecting passage 61 is formed to extend around the valve hole 4*d* (to avoid the position of valve hole 4*d*) and is connected with the high pressure chamber 44 of the control valve 40. The second connecting passage 62 is connected through the valve hole 4*d* to the medium pressure chamber 45 of the control valve 40.

Figure 10:
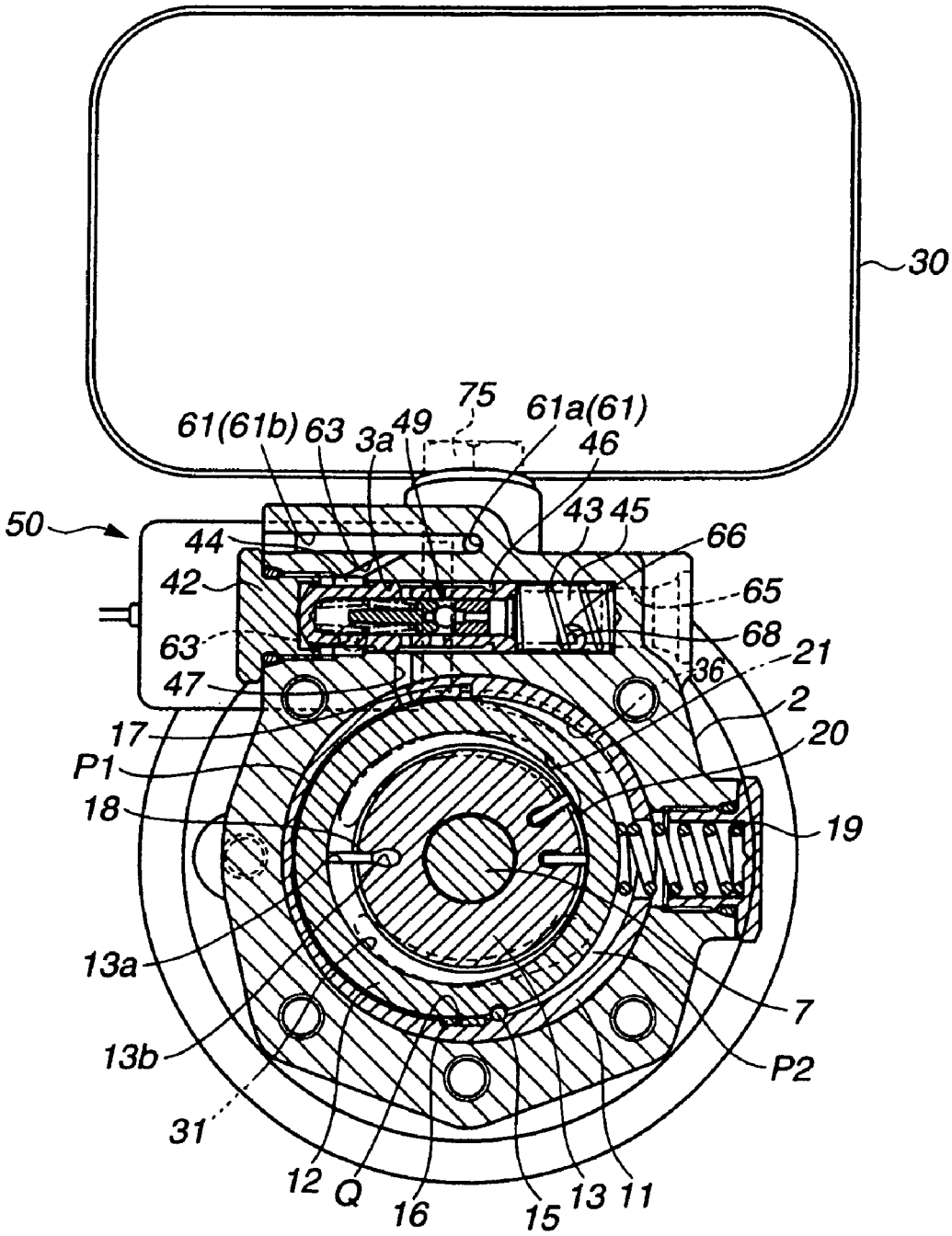
FIG. 10 is a cross-sectional view of FIG. 9, taken along a line G-G.

The first connecting passage 61 is formed in a curved line shape and extends from the above-mentioned branch point in the circumferential direction of valve hole 4*d* (i.e., extends in a radially-outward region along the outer circumferential surface of valve hole 4*d* to make a detour) so as not to communicate directly with the valve hole 4*d* as shown in FIGS. 9 to 11. This first connecting passage 61 includes a first fluid passage 61*a* and a second fluid passage 61*b*. The first fluid passage 61*a* is formed from a half detour point around the valve hole 4*d*, to extend toward the opening end side of the tubular portion 3 of front body 2 in a tangent direction of the valve hole 4*d*. The second fluid passage 61*b* is open to a predetermined axial point of a terminal portion of the first fluid passage 61*a*, more specifically, to an axial point of the first fluid passage 61*a* which is equal to an axial position of the center (center line) of the valve hole 3*a* of control valve 40, with respect to x-axis of FIG. 9. The second fluid passage 61*b* extends from this axial point of first fluid passage 61*a* in the extending direction of valve hole 3*a*. The second fluid passage 61*b* is connected with the high pressure chamber 44 of the control valve 40 through the first orifice 63. The first orifice 63 is formed from a substantially middle portion of the second fluid passage 61*b* obliquely to the high pressure chamber 44. In a manufacturing processing, the first connecting passage 61 is produced to be open to the opening end side of the tubular portion 3, and the second connecting passage 62 is produced to be open in the opening end direction of the valve hole 3*a*.

Since the first orifice 63 is provided obliquely as mentioned above, a flow-path length of the first orifice 63 can be made longer. Hence, the suppression effect of the pressure pulsation based on pressure lowering action is enhanced. Moreover, the first orifice 63 is formed obliquely to conform to the extending direction of the second fluid passage 61*b* (along a flow direction in the second fluid passage 61*b*), working fluid can be efficiently introduced from the second fluid passage 61*b* into the first orifice 63.

The second connecting passage 62 is provided on an extension of an upstream side (of a side upstream from the above-mentioned branch point) of the discharge passage 33, and is provided to intersect with the valve hole 4*d* of electromagnetic valve 50. The second connecting passage 62 is produced to be open to the upper end surface of the end wall portion 4 of front body 2, and this opening portion of second connecting passage 62 is closed by a bolt 75.

The valve hole 4*d* of electromagnetic valve 50 is communicated through a communicating path 80 with the outlet port 65. The communicating path 80 extends from an inner end of the small-diameter portion 4*e* in a depth direction of the valve hole 4*d*. Moreover, the valve hole 4*d* of electromagnetic valve 50 is communicated with the medium pressure chamber 45 of control valve 40 through the communicating passage 66. This communicating passage 66 is provided to linearly extend from the communicating path 80 in the extending direction of the drive shaft 7.

This communicating passage 66 is provided from the communicating path 80 to pass through the valve hole 3*a* of control valve 40 in the similar manner as that of the first embodiment. One end of the communicating passage 66 opens toward the opening end surface of the front body 2, and the second orifice 68 is provided at another end portion of the communicating passage 66. The second orifice 68 is formed so as to be open to (communicate with) the communicating path 80 in a diameter-reducing step shape.

In this embodiment, the discharge passage 33 (namely the second connecting passage 62) is connected with the annular passage 64, not with the second pressure chamber 67 in the electromagnetic valve 50. Accordingly, working fluid flowed from the pressure chamber 35 through the second connecting passage 62 into the annular passage 64 is introduced through the metering orifice 60 into the second pressure chamber 67. This metering orifice 60 is capable of varying the flow-passage cross-sectional area thereof according to the holding position of the valving element 51. The working fluid introduced into the second pressure chamber 67 is discharged through the communicating path 80 and the outlet port 65 to the external, and simultaneously a part of discharge fluid passing in the communicating path 80 is introduced through the communicating passage 66 into the medium pressure chamber 45 of control valve 40.

Therefore, in this second embodiment, the similar operations and effects as the first embodiment are obtained as a matter of course. Additionally, since the electromagnetic valve 50 is placed in the so-called horizontal posture, in other words, the electromagnetic valve 50 is arranged in parallel with the control valve 40 with respect to the moving directions of respective valving elements 51 and 41; particularly, an empty space formed between the pulley 8 and the outer surface (pulley-side surface) of the end wall portion 4 of front body 2 can be effectively used.

That is, by virtue of such an arrangement of the electromagnetic valve 50, the above-mentioned axial space C which is formed by the tubular base 4*a* of the end wall portion 4 provided to extend for receiving the first bearing 70*a* can be filled, i.e., can be narrowed. Furthermore, as compared with the case of vertical arrangement of the electromagnetic valve 50 in the first embodiment, whole of the apparatus becomes more compact since the electromagnetic unit 50*a* does not protrude upwardly from the pump body 1. Therefore, a mounting performance of the pump apparatus to a vehicle or the like can be further improved.

Although the invention has been described above with reference to certain embodiments of the invention, the invention is not limited to the embodiments described above.

Modifications and variations of the embodiments described above will occur to those skilled in the art in light of the above teachings.

For example, a shape or a size of the pump body 1 can be changed freely based on engineering specifications, a size and the like of an object in which the apparatus is mounted.

In the above respective embodiments; the electromagnetic valve 50 is used for varying the metering orifice 60, and the working fluid to be applied to the medium pressure chamber 45 of control valve 40 is controlled by means of this variable control of the metering orifice 60. In other words, the electromagnetic valve 50 functions as a device for indirectly controlling the control valve 40. However, this configuration is just one example of uses of the electromagnetic valve 50. As the other usage of the electromagnetic valve 50, the electromagnetic valve 50 can be configured to directly control the control valve 40 by the electromagnetic unit 50*a*. For example, the metering orifice 60 may be provided independently, and the electromagnetic valve 50 may be constructed to control fluid pressure within the pump body 1 by directly controlling the movement of the valving element 41 of control valve 40 by means of the movement of rod 56 of electromagnetic unit 50*a*.

Moreover, the power transmission means for transmitting power from the engine (not shown) to the drive shaft 7 is not limited to the pulley 8. For example, a sprocket may be used instead of the pulley 8, and driven by a chain.

The entire contents of Japanese Patent Application No. 2008-5152 filed on Jan. 15, 2008 are incorporated herein by reference.

The scope of the invention is defined with reference to the following claims.

What is claimed is:

1. A pump apparatus comprising:

a drive shaft supported rotatably in a pump body;

a power transmission member attached to one end portion of the drive shaft, and configured to transmit a power to the drive shaft;

a pump element received in the pump body, and configured to pressurize and discharge a working fluid by receiving a rotary drive of the drive shaft;

a discharge passage formed in the pump body, and configured to introduce the pressurized working fluid discharged from the pump element to an external of the pump body;

a control valve provided in the pump body, and configured to control an amount of working fluid to be discharged through the discharge passage to the external, by controlling a movement of a valving element of the control valve on the basis of the pressurized working fluid; and an electromagnetic valve provided between the power transmission member and the control valve in an axial direction of the drive shaft, and configured to control the control valve or a fluid pressure acting on the valving element of the control valve based on the pressurized working fluid.

2. The pump apparatus as claimed in claim 1, further comprising a communicating passage communicating the control valve with the electromagnetic valve.

3. The pump apparatus as claimed in claim 2, wherein the electromagnetic valve is provided on the discharge passage; and the control valve includes a high pressure chamber to which an upstream fluid pressure of the electromagnetic valve is applied, and a medium pressure chamber to which a downstream fluid pressure of the electromagnetic valve is applied.

4. The pump apparatus as claimed in claim 2, wherein the pump body includes a first housing and a second housing connected with each other;

the electromagnetic valve is provided in the first housing;

one end of the communicating passage is connected with the electromagnetic valve in the first housing, and another end of the communicating passage is open to one side surface of the first housing; and an orifice is provided at the one end of the communicating passage, the orifice being formed to reduce a diameter of the communicating passage, the orifice having a passage cross-sectional area smaller than that of the communicating passage.

5. The pump apparatus as claimed in claim 1, wherein the electromagnetic valve includes a valving element, and the control valve includes the valving element;

a moving direction of the valving element of the electromagnetic valve is substantially in parallel with a moving direction of the valving element of the control valve; and the valving element of the electromagnetic valve overlaps with the valving element of the control valve in a direction perpendicular to the moving direction.

6. The pump apparatus as claimed in claim 1, wherein the pump apparatus further comprises a reservoir tank for storing working fluid, the reservoir tank being fixed to the pump body; and the reservoir tank overlaps with at least a part of the valving element in the axial direction of the drive shaft.

7. A pump apparatus comprising:

a drive shaft supported rotatably in a pump body;

a cam ring received in the pump body, and capable of becoming eccentric relative to the drive shaft;

a rotor provided on an inner circumferential side of the cam ring, and including a plurality of slots formed in a radial direction of the rotor, the rotor being connected with the drive shaft;

a plurality of vanes received in the plurality of slots of the rotor, each of the plurality of vanes being movable in inward and outward directions of one of the plurality of slots, the plurality of vanes cooperating with the cam ring and the rotor to define a plurality of pump chambers;

a first plate member provided on one axial end surface of the cam ring;

a second plate member provided on another axial end surface of the cam ring, the first plate member and the second plate member supporting the cam ring by sandwiching the cam ring;

a suction port formed in at least one of the first plate member and the second plate member, and being open to an area within which a volume of each of the plurality of pump chambers becomes enlarged with a rotation of the rotor;

a discharge port formed in at least one of the first plate member and the second plate member, and being open to an area within which the volume of each pump chamber becomes reduced with the rotation of the rotor;

a seal member provided on an outer circumferential surface of the cam ring and dividing a space formed on the outer circumferential surface of the cam ring into a first fluid pressure chamber and a second fluid pressure chamber, a volume of the first fluid pressure chamber being configured to decrease with an increase of eccentricity of the cam ring, a volume of the second fluid pressure chamber being configured to increase with the increase of eccentricity of the cam ring;

a metering orifice formed in a discharge passage connected with the discharge port;

a control valve configured to adjust fluid pressure to be introduced into the first fluid pressure chamber or the second fluid pressure chamber, by controlling a movement of a valving element of the control valve on a basis of an upstream fluid pressure of the metering orifice and a downstream fluid pressure of the metering orifice;

a bracket attached to at least one side surface of the pump body via a connecting member;

an electromagnetic valve received by the pump body, the drive shaft being located between the bracket and the electromagnetic valve in the radial direction of the rotor, the electromagnetic valve being configured to control fluid pressure inside the pump body; and a first connecting passage connecting the discharge port with a pressure chamber of the control valve to which the upstream fluid pressure of the metering orifice is applied, and a second connecting passage connecting the discharge port with a pressure chamber of the control valve to which the downstream fluid pressure of the metering orifice is applied, wherein the suction port is substantially opposed to the discharge port in the radial direction of the rotor;

the bracket overlaps with the discharge port in an axial direction of the rotor;

the electromagnetic valve is provided on one end side of the second connecting passage;

the electromagnetic valve includes a valving element configured to move in an axial direction of the electromagnetic valve; and a passage center line of the one end side of the second connecting passage is substantially same as a moving line of the valving element of the electromagnetic valve.

8. The pump apparatus as claimed in claim 7, further comprising an inlet port formed to open to an outer surface of the pump body, and connected with a reservoir tank for storing working fluid; and a suction passage formed in the pump body, and configured to introduce working fluid within the reservoir tank through the inlet port into the suction port, wherein the inlet port is located on the same side as the electromagnetic valve relative to the drive shaft.

9. The pump apparatus as claimed in claim 7, wherein the bracket is attached to both side surfaces of the pump body in an extending direction of the drive shaft.

10. The pump apparatus as claimed in claim 7, wherein a power transmission member is provided at one end side of the drive shaft, and configured to transmit a power to the drive shaft; and the electromagnetic valve is located between the power transmission member and the control valve.

11. A pump apparatus comprising:

a drive shaft supported rotatably in a pump body;

a power transmission member attached to an outer circumferential portion of one end side of the drive shaft, and configured to transmit a power to the drive shaft;

a pump element received in the pump body, and configured to pressurize and discharge working fluid by receiving a rotary drive of the drive shaft;

a suction passage formed in the pump body, connected through an inlet port formed to open to an outer surface of the pump body, with a reservoir tank for storing working fluid, and configured to introduce working fluid sucked through the inlet port, into the pump element;

a discharge passage formed in the pump body, and configured to introduce the pressurized working fluid discharged from the pump element, to an external of the pump body;

a control valve provided in the pump body, and configured to control an amount of working fluid to be discharged through the discharge passage to the external, by controlling a movement of a valving element of the control valve based on a pressure level of the pressurized working fluid;

an electromagnetic valve provided in the pump body on a same side as the inlet port relative to the drive shaft, and configured to control the control valve or a fluid pressure acting on the valving element of the control valve based on the pressurized working fluid; and a communicating passage communicating the control valve with the electromagnetic valve, wherein the pump body includes a first housing and a second housing connected with each other;

the electromagnetic valve is provided in the first housing;

one end of the communicating passage is connected with the electromagnetic valve in the first housing, and another end of the communicating passage is open to one side surface of the first housing; and the another end of the communicating passage is closed by the second housing.

12. The pump apparatus as claimed in claim 11, wherein a metering orifice is formed in some point of the discharge passage;

the control valve includes a high pressure chamber to which an upstream fluid pressure of the metering orifice is applied, and a medium pressure chamber to which a downstream fluid pressure of the metering orifice is applied; and the electromagnetic valve is communicated through the communicating passage with the medium pressure chamber.

13. The pump apparatus as claimed in claim 11, wherein an orifice is provided at the one end of the communicating passage, the orifice being formed to reduce a diameter of the communicating passage, the orifice having a passage cross-sectional area smaller than that of the communicating passage.

14. The pump apparatus as claimed in claim 11, wherein the control valve is located between the inlet port and the electromagnetic valve.

15. The pump apparatus as claimed in claim 11, wherein the electromagnetic valve includes a valving element configured to move in an axial direction of the electromagnetic valve;

a discharge port of the pump element is connected with a pressure chamber of the control valve through a connecting passage; and a passage center line of one end side of the connecting passage is substantially same as a moving line of the valving element of the electromagnetic valve.

* * * * *